US008973319B2

(12) United States Patent
Pilz et al.

(10) Patent No.: US 8,973,319 B2
(45) Date of Patent: Mar. 10, 2015

(54) TWO-PIECE TRACK SYSTEM

(71) Applicant: California Expanded Metal Products Company, City of Industry, CA (US)

(72) Inventors: Donald A. Pilz, Livermore, CA (US); Raymond E. Poliquin, City of Industry, CA (US); Fernando Hernandez Sesma, CIty of Industry, CA (US)

(73) Assignee: California Expanded Metal Products Company, Industry, CA (US)

( * ) Notice: Subject to any disclaimer, the term of this patent is extended or adjusted under 35 U.S.C. 154(b) by 0 days.

(21) Appl. No.: 14/045,538

(22) Filed: Oct. 3, 2013

(65) Prior Publication Data

US 2014/0130433 A1 May 15, 2014

Related U.S. Application Data

(63) Continuation of application No. 13/858,826, filed on Apr. 8, 2013, now Pat. No. 8,555,566, which is a continuation-in-part of application No. 13/223,148, filed on Aug. 31, 2011, now Pat. No. 8,413,394, and a (Continued)

(51) Int. Cl.
*E06B 1/04* (2006.01)
*E04C 2/00* (2006.01)
(Continued)

(52) U.S. Cl.
CPC . *E04B 1/941* (2013.01); *E04B 1/38* (2013.01); *E04B 2/7411* (2013.01);
(Continued)

(58) Field of Classification Search
CPC ..... E04B 2/00; E04B 2/74; E04B 2/7409; E04B 2/7411; E04B 2/7457
USPC ..... 52/207, 241, 232, 481.1, 483.1, 844, 52/846, 848.1, 238.1, 167.1
See application file for complete search history.

(56) References Cited

U.S. PATENT DOCUMENTS 1,130,722 A 3/1915 Fletcher
1,563,651 A 12/1925 Pomerantz
(Continued)

FOREIGN PATENT DOCUMENTS

CA 2234347 10/1999
CA 2697295 12/2013
(Continued)

OTHER PUBLICATIONS

International Search Report for Application No. PCT/US2008/073920, dated Apr. 9, 2009.
(Continued)

*Primary Examiner* — Mark Wendell
(74) *Attorney, Agent, or Firm* — Knobbe Martens Olson & Bear LLP

(57) ABSTRACT

A fire-rated receiver channel includes at least one intumescent or other fire-resistant material strip. The receiver channel can nest with a framing member, such as metal tracks, headers, header tracks, sill plates, bottom tracks, metal studs, wood studs or wall partitions, and placed at a perimeter of a wall assembly to create a fire block arrangement. In other arrangements, a track assembly includes two nested tracks, an inner track and outer track. The assembly is designed so that the outside width of the outer track is equal to or less than the outside width of the inner track to present a substantially flush external surface for attachment of exterior sheathing elements when the assembly is used in an external wall.

11 Claims, 15 Drawing Sheets

Related U.S. Application Data continuation-in-part of application No. 12/325,943, filed on Dec. 1, 2008, now Pat. No. 8,499,512, said application No. 13/223,148 is a continuation-in-part of application No. 12/834,360, filed on Jul. 12, 2010, now Pat. No. 8,132,376, which is a continuation of application No. 12/040,658, filed on Feb. 29, 2008, now Pat. No. 7,752,817, said application No. 12/325,943 is a continuation-in-part of application No. 12/039,685, filed on Feb. 28, 2008, now Pat. No. 8,281,552.

(60) Provisional application No. 60/954,029, filed on Aug. 6, 2007, provisional application No. 61/379,047, filed on Sep. 1, 2010, provisional application No. 61/021,418, filed on Jan. 16, 2008.

(51) Int. Cl.

| | |
|---|---|
| ***E04H 1/00*** | (2006.01) |
| ***E04C 3/00*** | (2006.01) |
| ***E04B 1/94*** | (2006.01) |
| ***E04B 1/38*** | (2006.01) |
| ***E04B 2/74*** | (2006.01) |
| ***E04B 2/76*** | (2006.01) |
| ***E04C 3/09*** | (2006.01) |
| ***E04B 2/82*** | (2006.01) |
| *E04C 3/04* | (2006.01) |

(52) U.S. Cl.

CPC ..... *E04B 2/7457* (2013.01); *E04B 2/768* (2013.01); *E04C 3/09* (2013.01); *E04B 2/828* (2013.01); *E04B 1/944* (2013.01); *E04C 2003/0417* (2013.01); *E04C 2003/0473* (2013.01)

USPC ..... 52/232; 52/241; 52/481.1

(56) References Cited

U.S. PATENT DOCUMENTS

| | | | |
|---|---|---|---|
| 2,218,426 | A | 10/1940 | Hulbert, Jr. |
| 2,683,927 | A | 7/1954 | Maronek |
| 2,733,786 | A | 2/1956 | Drake |
| 3,129,792 | A | 4/1964 | Gwynne |
| 3,271,920 | A | 9/1966 | Downing, Jr. |
| 3,324,615 | A | 6/1967 | Zinn |
| 3,397,495 | A | 8/1968 | Thompson |
| 3,481,090 | A | 12/1969 | Lizee |
| 3,537,219 | A | 11/1970 | Navarre |
| 3,566,559 | A | 3/1971 | Dickson |
| 3,744,199 | A | 7/1973 | Navarre |
| 3,786,604 | A | 1/1974 | Kramer |
| 3,837,126 | A | 9/1974 | Voiturier et al. |
| 3,839,839 | A | 10/1974 | Tillisch et al. |
| 3,908,328 | A | 9/1975 | Nelsson |
| 3,935,681 | A | 2/1976 | Voiturier et al. |
| 3,955,330 | A | 5/1976 | Wendt |
| 3,964,214 | A | 6/1976 | Wendt |
| 3,974,607 | A | 8/1976 | Balinski |
| 4,011,704 | A | 3/1977 | O'Konski |
| 4,103,463 | A | 8/1978 | Dixon |
| 4,130,972 | A | 12/1978 | Varlonga |
| 4,144,335 | A | 3/1979 | Edwards |
| 4,144,385 | A | 3/1979 | Downing |
| 4,152,878 | A | 5/1979 | Balinski |
| 4,164,107 | A | 8/1979 | Kraemling et al. |
| 4,178,728 | A | 12/1979 | Ortmanns et al. |
| 4,203,264 | A | 5/1980 | Kiefer et al. |
| 4,283,892 | A | 8/1981 | Brown |
| 4,318,253 | A | 3/1982 | Wedel |
| 4,329,820 | A | 5/1982 | Wendt |
| 4,424,653 | A | 1/1984 | Heinen |
| 4,437,274 | A | 3/1984 | Slocum et al. |
| 4,649,089 | A | 3/1987 | Thwaites |
| 4,672,785 | A | 6/1987 | Salvo |
| 4,709,517 | A | 12/1987 | Mitchell et al. |
| 4,723,385 | A | 2/1988 | Kallstrom |
| 4,787,767 | A | 11/1988 | Wendt |
| 4,825,610 | A | 5/1989 | Gasteiger |
| 4,850,385 | A | 7/1989 | Harbeke |
| 4,885,884 | A | 12/1989 | Schilger |
| 4,918,761 | A | 4/1990 | Harbeke |
| 4,930,276 | A | 6/1990 | Bawa et al. |
| 5,010,702 | A | 4/1991 | Daw et al. |
| 5,094,780 | A | 3/1992 | von Bonin |
| 5,103,589 | A | 4/1992 | Crawford |
| 5,125,203 | A | 6/1992 | Daw |
| 5,127,203 | A | 7/1992 | Paquette |
| 5,127,760 | A | 7/1992 | Brady |
| 5,146,723 | A | 9/1992 | Greenwood et al. |
| 5,155,957 | A | 10/1992 | Robertson et al. |
| 5,157,883 | A | 10/1992 | Meyer |
| 5,167,876 | A | 12/1992 | Lem |
| 5,173,515 | A | 12/1992 | von Bonin et al. |
| 5,222,335 | A | 6/1993 | Petrecca |
| 5,244,709 | A | 9/1993 | Vanderstukken |
| 5,285,615 | A | 2/1994 | Gilmour |
| 5,315,804 | A | 5/1994 | Attalla |
| 5,325,651 | A | 7/1994 | Meyer et al. |
| 5,347,780 | A | 9/1994 | Richards et al. |
| 5,367,850 | A | 11/1994 | Nicholas |
| 5,374,036 | A | 12/1994 | Rogers et al. |
| 5,390,465 | A | 2/1995 | Rajecki |
| 5,394,665 | A | 3/1995 | Johnson |
| 5,412,919 | A | 5/1995 | Pellock et al. |
| 5,452,551 | A | 9/1995 | Charland et al. |
| 5,454,203 | A | 10/1995 | Turner |
| 5,456,050 | A | 10/1995 | Ward |
| 5,471,805 | A | 12/1995 | Becker |
| 5,552,185 | A | 9/1996 | De Keyser |
| 5,592,796 | A | 1/1997 | Landers |
| 5,604,024 | A | 2/1997 | von Bonin |
| 5,644,877 | A | 7/1997 | Wood |
| 5,687,538 | A | 11/1997 | Frobosilo et al. |
| 5,689,922 | A | 11/1997 | Daudet |
| 5,709,821 | A | 1/1998 | von Bonin et al. |
| 5,740,643 | A | 4/1998 | Huntley |
| 5,755,066 | A | 5/1998 | Becker |
| 5,787,651 | A | 8/1998 | Horn et al. |
| 5,797,233 | A | 8/1998 | Hascall |
| 5,806,261 | A | 9/1998 | Huebner et al. |
| 5,913,788 | A | 6/1999 | Herren |
| 5,921,041 | A | 7/1999 | Egri, II |
| 5,927,041 | A | 7/1999 | Sedlmeier et al. |
| 5,930,963 | A | 8/1999 | Nichols |
| 5,950,385 | A | 9/1999 | Herren |
| 5,968,669 | A | 10/1999 | Liu et al. |
| 6,058,668 | A | 5/2000 | Herren |
| 6,110,559 | A | 8/2000 | De Keyser |
| 6,151,858 | A | 11/2000 | Ruiz et al. |
| 6,176,053 | B1 | 1/2001 | St. Germain |
| 6,182,407 | B1 | 2/2001 | Turpin et al. |
| 6,189,277 | B1 | 2/2001 | Boscamp |
| 6,207,077 | B1 | 3/2001 | Burnell-Jones |
| 6,207,085 | B1 | 3/2001 | Ackerman |
| 6,213,679 | B1 | 4/2001 | Frobosilo et al. |
| 6,216,404 | B1 | 4/2001 | Vellrath |
| 6,233,888 | B1 | 5/2001 | Wu |
| 6,305,133 | B1 | 10/2001 | Cornwall |
| 6,374,558 | B1 | 4/2002 | Surowiecki |
| 6,381,913 | B2 | 5/2002 | Herren |
| 6,405,502 | B1 | 6/2002 | Cornwall |
| 6,430,881 | B1 | 8/2002 | Daudet et al. |
| 6,470,638 | B1 | 10/2002 | Larson |
| 6,606,831 | B2 | 8/2003 | Degelsegger |
| 6,647,691 | B2 | 11/2003 | Becker et al. |
| 6,668,499 | B2 | 12/2003 | Degelsegger |
| 6,679,015 | B1 | 1/2004 | Cornwall |
| 6,705,047 | B2 | 3/2004 | Yulkowski |
| 6,732,481 | B2 | 5/2004 | Stahl, Sr. |
| 6,783,345 | B2 | 8/2004 | Morgan et al. |
| 6,799,404 | B2 | 10/2004 | Spransy |
| 6,843,035 | B1 | 1/2005 | Glynn |

(56) References Cited

U.S. PATENT DOCUMENTS

| | | | | |
|---|---|---|---|---|
| 6,854,237 | B2 | 2/2005 | Surowiecki | |
| 6,871,470 | B1 | 3/2005 | Stover | |
| 7,043,880 | B2 | 5/2006 | Morgan et al. | |
| 7,059,092 | B2 | 6/2006 | Harkins et al. | |
| 7,152,385 | B2 | 12/2006 | Morgan et al. | |
| 7,191,845 | B2 | 3/2007 | Loar | |
| 7,240,905 | B1 | 7/2007 | Stahl | |
| 7,302,776 | B2 | 12/2007 | Duncan et al. | |
| 7,487,591 | B2 | 2/2009 | Harkins et al. | |
| 7,506,478 | B2 | 3/2009 | Bobenhausen | |
| 7,513,082 | B2 | 4/2009 | Johnson | |
| 7,540,118 | B2 | 6/2009 | Jensen | |
| 7,617,643 | B2 | 11/2009 | Pilz et al. | |
| 7,681,365 | B2 | 3/2010 | Klein | |
| 7,752,817 | B2 | 7/2010 | Pilz et al. | |
| 7,775,006 | B2 | 8/2010 | Giannos | |
| 7,776,170 | B2 | 8/2010 | Yu et al. | |
| 7,814,718 | B2 | 10/2010 | Klein | |
| 7,827,738 | B2 | 11/2010 | Abrams et al. | |
| 7,866,108 | B2 | 1/2011 | Klein | |
| 7,950,198 | B2 | 5/2011 | Pilz et al. | |
| 8,056,293 | B2 | 11/2011 | Klein | |
| 8,061,099 | B2 | 11/2011 | Andrews | |
| 8,069,625 | B2 | 12/2011 | Harkins et al. | |
| 8,074,416 | B2 | 12/2011 | Andrews | |
| 8,087,205 | B2 | 1/2012 | Pilz et al. | |
| 8,100,164 | B2 | 1/2012 | Goodman et al. | |
| 8,132,376 | B2 | 3/2012 | Pilz et al. | |
| 8,136,314 | B2 | 3/2012 | Klein | |
| 8,151,526 | B2 | 4/2012 | Klein | |
| 8,181,404 | B2 * | 5/2012 | Klein | 52/232 |
| 8,225,581 | B2 | 7/2012 | Strickland et al. | |
| 8,281,552 | B2 | 10/2012 | Pilz et al. | |
| 8,322,094 | B2 | 12/2012 | Pilz et al. | |
| 8,353,139 | B2 | 1/2013 | Pilz | |
| 8,413,394 | B2 | 4/2013 | Pilz et al. | |
| 8,495,844 | B1 | 7/2013 | Johnson | |
| 8,499,512 | B2 | 8/2013 | Pilz et al. | |
| 8,555,566 | B2 | 10/2013 | Pilz et al. | |
| 8,590,231 | B2 | 11/2013 | Pilz | |
| 8,595,999 | B1 | 12/2013 | Pilz et al. | |
| 8,640,415 | B2 | 2/2014 | Pilz et al. | |
| 8,671,632 | B2 | 3/2014 | Pilz et al. | |
| 2002/0170249 | A1 | 11/2002 | Yulkowski | |
| 2003/0079425 | A1 | 5/2003 | Morgan et al. | |
| 2003/0089062 | A1 | 5/2003 | Morgan et al. | |
| 2003/0213211 | A1 | 11/2003 | Morgan et al. | |
| 2004/0010998 | A1 | 1/2004 | Turco | |
| 2004/0016191 | A1 | 1/2004 | Whitty | |
| 2004/0045234 | A1 | 3/2004 | Morgan et al. | |
| 2004/0139684 | A1 | 7/2004 | Menendez | |
| 2004/0211150 | A1 | 10/2004 | Bobenhausen | |
| 2005/0183361 | A1 | 8/2005 | Frezza | |
| 2005/0246973 | A1 | 11/2005 | Jensen | |
| 2006/0032163 | A1 | 2/2006 | Korn | |
| 2006/0123723 | A1 | 6/2006 | Weir et al. | |
| 2007/0056245 | A1 | 3/2007 | Edmondson | |
| 2007/0068101 | A1 | 3/2007 | Weir et al. | |
| 2007/0193202 | A1 | 8/2007 | Rice | |
| 2007/0261343 | A1 | 11/2007 | Stahl, Sr. | |
| 2008/0087366 | A1 | 4/2008 | Yu et al. | |
| 2008/0134589 | A1 | 6/2008 | Abrams et al. | |
| 2008/0172967 | A1 | 7/2008 | Hilburn | |
| 2008/0250738 | A1 | 10/2008 | Howchin | |
| 2009/0178369 | A1 | 7/2009 | Pilz et al. | |
| 2011/0067328 | A1 | 3/2011 | Naccarato et al. | |
| 2011/0099928 | A1 | 5/2011 | Klein et al. | |
| 2011/0167742 | A1 | 7/2011 | Klein | |
| 2011/0185656 | A1 | 8/2011 | Klein | |
| 2011/0214371 | A1 | 9/2011 | Klein | |
| 2012/0066989 | A1 | 3/2012 | Pilz et al. | |
| 2012/0266550 | A1 | 10/2012 | Naccarato et al. | |
| 2012/0297710 | A1 | 11/2012 | Klein | |
| 2013/0031856 | A1 | 2/2013 | Pilz et al. | |
| 2013/0086859 | A1 | 4/2013 | Pilz | |
| 2013/0118102 | A1 | 5/2013 | Pilz | |
| 2014/0075865 | A1 | 3/2014 | Pilz | |

FOREIGN PATENT DOCUMENTS

| | | |
|---|---|---|
| EP | 0 346 126 | 12/1989 |
| GB | 2 159 051 | 11/1985 |
| GB | 2 411 212 | 8/2005 |
| JP | 06-146433 | 5/1994 |
| JP | 06-220934 | 8/1994 |
| WO | WO 03/038206 | 5/2003 |
| WO | WO 2007/103331 | 9/2007 |
| WO | WO 2009/026464 | 2/2009 |

OTHER PUBLICATIONS

BlazeFrame 2009 catalog of products, available at least as of Mar. 4, 2010 from www.blazeframe.com, in 20 pages.

Catalog page from Stockton Products, printed from www.stocktonproducts.com, on Dec. 16, 2007, showing #5 Drip, in 1 page.

DoubleTrackTM information sheets by Dietrich Metal Framing, in 2 pages; accessible on Internet Wayback Machine on Jul. 8, 2006.

FireStikTM by CEMCO Brochure, published on www.firestik.us, in 18 pages; accessible on Internet Wayback Machine on Aug. 13, 2007.

* cited by examiner

TWO-PIECE TRACK SYSTEM

RELATED APPLICATIONS

Related applications are listed in an Application Data Sheet (ADS) filed with the present application. The entirety of each application listed in the ADS is hereby incorporated by reference herein. Also incorporated by reference herein in their entireties are U.S. Pat. No. 7,617,643 entitled Fire-Rated Wall Construction Product, U.S. Pat. No. 8,499,512 entitled Exterior Wall Construction Product, U.S. Pat. No. 8,353,139 entitled Wall Gap Fire Block Device, System and Method, and U.S. Patent Publication No. 2011/0247281, entitled Fire-Rated Wall Construction Product.

BACKGROUND OF THE INVENTION

1. Field of the Invention

This application is directed toward a two-piece track system for use in building construction, particularly for use in the interior and/or exterior wall of a building.

2. Description of the Related Art

Two-piece track systems for use in building construction are generally well known, as are two-piece track systems for use in the exterior and/or interior wall of a building that can allow for independent environmental movement of the tracks relative to one another. Two-piece track systems generally resemble both an outer U-shaped (or some other similar shaped) elongated tube, or track, and an inner U-shaped (or some other similar shaped) elongated tube, or track. Typically, the inner track is designed to receive or cover the ends of wall studs, and the outer track is designed to receive the inner track. Header tracks, including slotted tracks, are commonly used in the construction industry, including in the exterior walls of buildings. They generally resemble a U-shaped (or some other similarly shaped) elongated channel capable of receiving or covering the ends of wall studs and holding the wall studs in place.

The slotted tracks generally have a web and at least one flange. Typically, the track includes a pair of flanges, which extend in the same direction from opposing edges of the web. Along the flanges of the slotted tracks generally is a plurality of slots. When the wall studs are placed into a slotted track, the plurality of slots accommodate fasteners to permit attachment of the wall studs to the slotted track. The slots allow the wall studs to move generally orthogonally relative to the track. In two-piece track systems, independent movement of the tracks is sometimes desirable. The inner track is generally not confined in all directions, and thus is able to move independently from the outer track. Often times in use, the inner track is able to generally slide alongside the outer track in a horizontal or longitudinal direction relative to the outer track. In those areas of the world where earthquakes are common, this longitudinal or horizontal movement is important. If the inner track were not allowed to move freely in a generally longitudinal or horizontal direction, the stability of the wall and the building might be compromised. Furthermore, if the wall studs are rigidly attached to the slotted track and not allowed to move freely in at least one direction, the stability of the wall and the building might be compromised. With the plurality of slots, the wall studs are free to move.

Also along the flanges of the slotted tracks generally are areas for attachment of exterior sheathing elements. However, in many current slotted tracks, the slots take up the majority of the flanges of the track, leaving little room for attachment of exterior sheathing elements. For example, angle-shaped sheet metal tracks are commonly used on the outsides of wall studs. Each of these angle-shaped sheet metal tracks has a top web portion and one extending flange portion. The extending flange portion normally has a plurality of slots, but the slots extend nearly to the intersection of the flange and web. Because of this, there is little room for attachment of exterior sheathing elements to the flange of the slotted track.

In building construction it is not uncommon to have pieces of sheathing, or façade, attached to the outside of the building. These pieces of sheathing generally extend vertically alongside and down the exterior portion of the tracks and wall studs. The pieces of sheathing are attached to the tracks and/or wall studs by some connection means such as a screw or screws. In current two-piece track systems, the outer track's greatest width is larger than the inner track's greatest width. This creates an uneven outer surface for attachment of the sheathing. As a result, often sheathing elements flare out at their ends to accommodate for the uneven surface created by the different track widths.

Also, it is often difficult to keep the inner track from pulling or slipping away relative to the outer track during the installation procedure. In current two-piece track systems, screws are used to temporarily hold the outer and inner tracks in place during construction. If these screws are not removed after the wall is framed, the inner track will not be able to move as is desired.

It is also desirable or even mandatory to provide fire block arrangements at one or more linear wall gaps, which may be present between the top, bottom or sides of a wall and the adjacent structure. The fire block arrangements often involve the time-consuming process of inserting by hand a fire resistant material into the wall gap and then applying a flexible sealing layer to hold the fire resistant material in place. More recently, heat-expandable intumescent fire block materials have been integrated into the top or bottom track of the stud wall assembly.

SUMMARY OF THE INVENTION

It has been discovered by the present inventor that it is also often difficult to identify the proper location for attachment of an exterior sheathing element along the flange of a slotted track. If the sheathing elements are misaligned and overlap a portion of the plurality of slots, the generally orthogonal movement of the studs can be limited due to interference between the stud fastener, which passes through one of the plurality of slots, and the sheathing element.

Some embodiments are directed toward an improved slotted track device and system capable of use in building construction. It is well-suited for use in the exterior wall of a building, but can be used in other applications as well. The device includes a plurality of slots located along at least one flange of the slotted track. The slots permit attachment of the slotted track to a wall stud or studs. The slots also allow for generally orthogonal movement of the wall studs relative to the slotted track during an earthquake or some other event where movement of the studs is desired.

Furthermore, it can be desirable for the intumescent material to be secured to a track member that is separate from the top or bottom track that directly receives or supports the studs, or separate from the stud in the case of a side wall gap. Such an arrangement enhances or maximizes the deflection length available for a slotted track (or other dynamic header) for a given flange length by separating the intumescent-carrying flanges from the slotted flanges. The arrangement also provides flexibility in that it allows different header tracks, footer tracks or studs to be used in combination with a single track incorporating the intumescent material. In addition, a two-piece track or track/stud arrangement can facilitate the creation of a seal between the components of the wall assembly and the adjacent structure. The intumescent material can be placed at a suitable location on the track member, such as along a side flange and/or a side edge portion of the web. Preferably, the header track, bottom track or stud is snugly received in the track member incorporating the intumescent, such that little or no gap is present between them.

An embodiment involves a two-piece fire-rated track assembly for a linear wall gap. The assembly includes a first track that has a web, a first flange and a second flange. The web is substantially planar and has a first side edge and a second side edge. The first flange and the second flange extend in the same direction from the first and second side edges, respectively. Each of the first and second flanges is substantially planar such that the first track defines a substantially U-shaped cross section. A second track has a web, a first flange and a second flange. The web is substantially planar and has a first side edge and a second side edge. The first flange and the second flange extend in the same direction from the first and second side edges, respectively. Each of the first and second flanges is substantially planar such that the second track defines a substantially U-shaped cross section. Each of the first and second flanges has a free end opposite a respective one of the first side edge and second side edge. Each of the free ends defines a kick-out portion that extends in a direction opposite the web and away from the other kick-out portion. At least one heat-expandable intumescent strip is attached to the second track and extends lengthwise along an outer surface of one of the first and second flanges. The intumescent strip includes a portion that extends past an outer surface of the web of the second track. The first track is snugly nested within the second track such that there is little or no gap therebetween.

An embodiment involves a wall assembly having a head-of-wall seal arrangement. The wall assembly includes a header track extending in a lengthwise direction of the wall assembly. The header track includes a web, a first flange and a second flange. The first and second flanges extend downwardly from the web. Each of the web, the first flange and the second flange are substantially planar such that the header track defines a substantially U-shaped cross section. Each of the first flange and the second flange includes a free end and the free ends define a header track width therebetween. The wall assembly also includes a bottom track that extends in the lengthwise direction and has a web, a first flange and a second flange. The first and second flanges extend upwardly from the web. The wall assembly further includes a plurality of studs each having an upper end and a lower end, the lower end of each stud received within and secured to the bottom track and the upper end of each stud received within the header track. The wall assembly also includes a receiver channel extending in the lengthwise direction and having a web, a first flange and a second flange, the first and second flanges extending downwardly from the web such that the receiver channel defines a substantially U-shaped cross section. A width of the web of the receiver channel is greater than the header track width such that the first flange and the second flange of the receiver channel are positioned outwardly of the free ends of the first flange and the second flange of the header track, respectively, and the header track is nested within the receiver channel. Each of the web, the first flange and the second flange of the receiver channel comprises a heat-expandable intumescent material.

Another embodiment involves a building structure. The building structure includes a ceiling and a wall assembly. The wall assembly includes a header track secured to the ceiling and extending in a lengthwise direction of the wall assembly. The header track includes a web, a first flange and a second flange, the first and second flanges extending downwardly from the web, each of the web, the first flange and the second flange being substantially planar such that the header track defines a substantially U-shaped cross section, wherein each of the first flange and the second flange includes a free end and the free ends define a header track width therebetween. The wall assembly also includes a bottom track extending in the lengthwise direction and having a web, a first flange and a second flange, the first and second flanges extending upwardly from the web. The wall assembly further includes a plurality of studs each having an upper end and a lower end, the lower end of each stud received within and secured to the bottom track and the upper end of each stud received within and movable in a vertical direction relative to the header track. The wall assembly also includes a receiver channel extending in the lengthwise direction and positioned between the header track and the ceiling, the receiver channel having a web, a first flange and a second flange, the first and second flanges extending downwardly from the web such that the receiver channel defines a substantially U-shaped cross section, wherein a width of the web of the receiver channel is greater than the header track width such that the first flange and the second flange of the receiver channel are positioned outwardly of the first flange and the second flange of the header track, respectively, and wherein the header track is nested within the receiver channel, wherein each of the web, the first flange and the second flange of the receiver channel comprises a heat-expandable intumescent material such that at least a portion of the heat-expandable intumescent material is positioned between the header track and the ceiling. The wall assembly also includes at least one wallboard coupled to and movable with the plurality of studs, wherein the wallboard overlaps at least a portion of one of the first flange and the second flange of the header track and at least a portion of one of the first flange and the second flange of the receiver channel.

In some arrangements, the at least one intumescent strip extends along and is attached to a portion of the web of the second track. The at least one intumescent strip can define a total length in a cross-sectional direction, wherein a portion of the total length located on the flange is at least five times greater than a portion of the total length on the web. The at least one intumescent strip can cover a substantial entirety of the outer surface of the flange. The at least one intumescent strip can be a first intumescent strip and a second intumescent strip on the first and second flanges, respectively.

In some arrangements, the first and second flanges of the first track are longer than the first and second flanges of the second track. The first and second flanges of the first track can be at least about twice as long as the first and second flanges of the second track. The assembly can include a plurality of slots on the first and second flanges of the first track, wherein the slots extend in a direction perpendicular to a length of the first track. The first track can be a footer or header track, or a stud.

An embodiment involves a fire-rated wall assembly including a header track having a web, a first flange and a second flange. The first and second flanges extend downwardly from the web and include a plurality of slots that extend in a vertical direction and are spaced along a length of the header track. A bottom track has a web, a first flange and a second flange. The first and second flanges extend upwardly from the web. A plurality of studs each has an upper end and a lower end. The lower end of each stud is received within and secured to the bottom track and the upper end of each stud is received within the header track. For each of the plurality of studs, one of a plurality of fasteners is passed through one of the plurality of slots of the first flange and into the upper end of the stud and another of the plurality of fasteners is passed through one of the plurality of the slots of the second flange and into the upper end of the stud. A receiver channel has a web, a first flange and a second flange. The first and second flanges extend downwardly from the web. The header track is snugly nested within the receiver channel and the first and second flanges of the receiver channel are shorter than the first and second flanges of the header track such that lower portions of the first and second flanges of the header track, including at least lower portions of each of the plurality of slots, are exposed from the receiver channel. At least one heat-expandable intumescent strip is attached to the receiver channel and extends lengthwise along an outer surface of one of the first and second flanges. The intumescent strip includes a portion that extends past an outer surface of the web of the receiver channel.

In some arrangements, at least one wallboard is coupled to the plurality of studs. The wallboard overlaps the one of the first flange and the second flange of the header track to which the at least one intumescent strip is attached and the one of the first flange and the second flange of the receiver channel to which the at least one intumescent strip is attached. The wallboard can overlap the at least one intumescent strip.

In some arrangements, each of the first and second flanges of the receiver channel has a free end opposite the web, and each of the free ends defines a kick-out portion that extends in a direction opposite the web and away from the other kick-out portion. The at least one intumescent strip can extend along and can be attached to a portion of the web of the receiver channel. The at least one intumescent strip can define a total length in a cross-sectional direction, wherein a portion of the total length located on the flange is at least five times greater than a portion of the total length on the web. The at least one intumescent strip can cover a substantial entirety of the outer surface of the flange. The at least one intumescent strip can be a first intumescent strip and a second intumescent strip on the first and second flanges, respectively. The first and second flanges of the header track can be at least about twice as long as the first and second flanges of the receiver channel.

Similarly, a need exists for improved two-piece track arrangements that may or may not include fire-resistant materials and that can be constructed for interior or exterior applications. A preferred system comprises an inner track configured to receive a plurality of wall studs therewithin, and an outer track configured to receive the inner track within the outer track. The outer track is configured so that its greatest width is equal to or less than the greatest width of the inner track, thus presenting a general flush surface for attachment of sheathing to the track when the system is used in an exterior wall. In some embodiments, the track flanges may comprises a plurality of angled surfaces to permit a mating nesting arrangement that has an added benefit of preventing separation of the two tracks once nested. The system may further comprise a strap or series of engaging surfaces on the inner and outer tracks that generally restrain the inner track relative to the outer track in addition and/or in lieu of angled flange surfaces.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. It is to be understood that the attached drawings are for the purpose of illustrating concepts of the embodiments discussed herein and may not be to scale.

In FIG. 8, the head-of-wall arrangement is in a position with the head-of-wall gap closed.

DETAILED DESCRIPTION OF THE PREFERRED EMBODIMENTS

Figure 1:
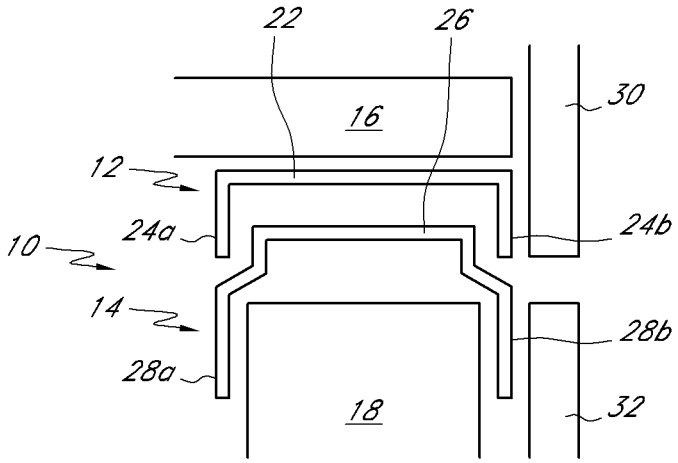
FIG. 1 illustrates a cross-sectional schematic view of one embodiment of the present inventive two-piece track assembly as applied to an exterior wall.

Referring to FIG. 1, a first embodiment of the inventive track assembly 10 comprises a first outer track 12 and a second nested track 14 therewithin. The track assembly is configured to be attached via one of various known fastening means to a ceiling surface 16 of a building and to engage a plurality of vertical stud members 18. The outer track 12 comprises a web 22 and two side flanges 24*a* and 24*b*. Similarly, the inner track 14 comprises a web 26 and two side flanges 28*a* and 28*b*. The outer and inner tracks 12, 14 are matingly configured so that the inner track 14 can nest within the outer track 12 when assembled to prevent generally side-to-side movement but permit relative longitudinal movement along the length of the tracks.

It is desirable that the greatest width of the outer track 12 be no greater than the greatest width of the inner track 14; i.e., equal to or less than the greatest width of the inner track 14. In the embodiments shown by example in FIGS. 1 and 2, the widths of the two tracks are substantially equivalent. In these embodiments, the essentially flush configuration is accomplished by flaring the side flanges 28*a* and 28*b* of inner track 14 at their ends to a width equal to that of the outer track.

Although the present invention is applicable to both interior and exterior walls, in the context of an exterior wall specifically, it is contemplated that outer sheathing would be attached to the track assembly 10, with an upper sheathing board 30 and a lower sheathing board 32 positioned below it. By configuring the outer and inner tracks 12, 14 as described herein, the two-piece track system 10 may present a substantially flush surface profile alongside sheathing board 30 and 32, which minimizes flaring of the sheathing boards and creates a desirable building surface. Where the width of the outer track is meaningfully less than the width of the inner track, it is still possible to utilize and attach flat sheathing elements to maintain a flush building profile, although a small gap may exist (not shown) between the flange 24*b* and upper sheathing board 30 undetectable from outside the building.

When applied to a building, the track assembly 10 is secured to the ceiling surface 16 by securing the web 22 of outer track 12 to the ceiling surface by way of conventional fastening means (not shown). The inner track 14 may be slipped into the outer track either by way of a snap fit or other application. When shipped as a combined assembly, each track web 22, 26 comprises aligned holes and/or slots for permitting a fastener to be directed through the inner track web 26 and to engage the web 22 of the outer track 12 to the ceiling surface.

Figure 2:
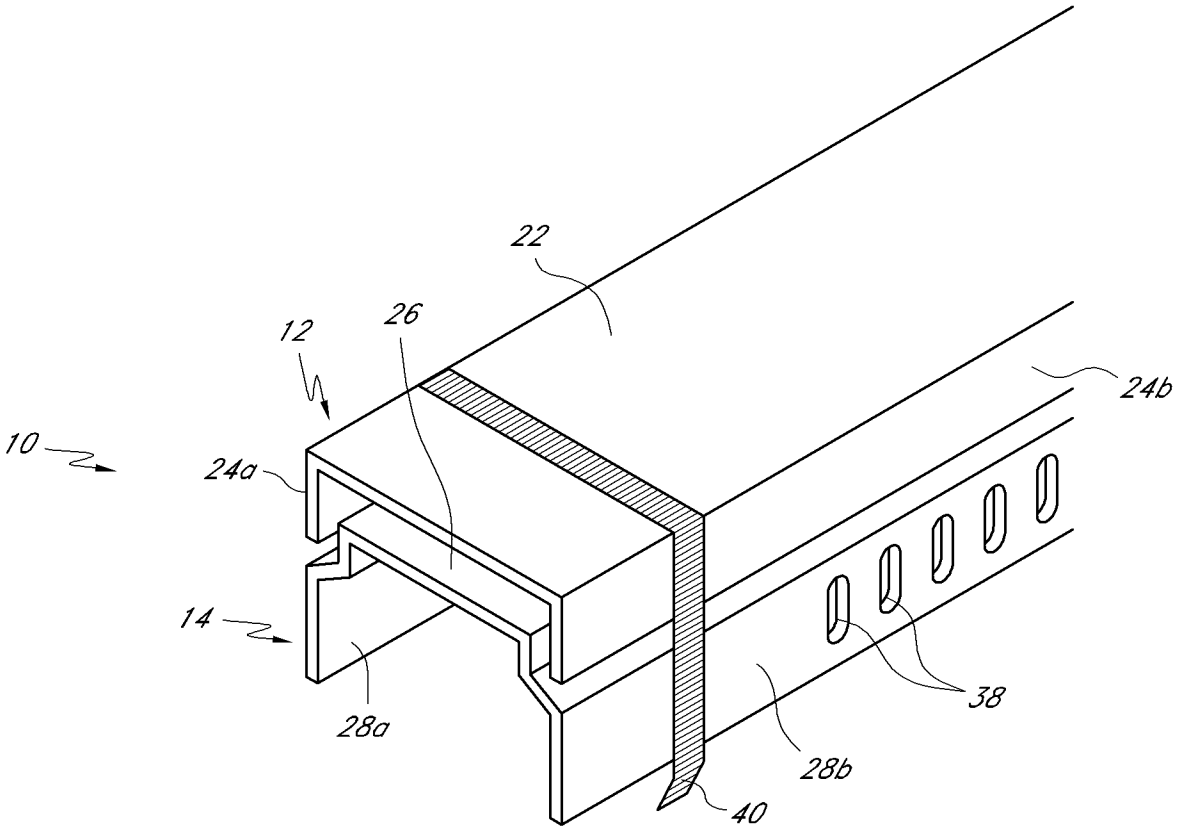
FIG. 2 illustrates a perspective schematic view of another embodiment of the inventive two-piece track assembly.

In current two-piece track systems, it is often necessary to use screws or similar devices to hold the two tracks together during installation or building construction. If the screws are not eventually pulled out after the wall is framed, the screws that were installed will prevent the inner track from being able to move independently from the outer track. One embodiment of the present invention overcomes this deficiency. Referring to FIG. 2, another embodiment of the invention comprises the two-piece track system 10 of FIG. 1 further comprising a plurality of slots 38 along side flange 28*b* to permit vertical movement of the stud members 18 relative to the track assembly 10. The embodiment further comprises a setting strap 40 for securing tracks 12 and 14 together during transport and installation. In one application, the strap 40 may be placed over the outer track 12 and extend down along side flanges 24 and 28 of the outer and inner tracks, respectively. Once the inner track 14 is installed within, or relative to, the outer track 12, the setting strap 40 is desirably flared inwardly at its end. This is done to generally restrain the inner track from being pulled away from the outer track, while still allowing for at least some movement of the tracks relative to one another. For each length of track assembly 10, one or more setting straps 40 may be used. Other mechanisms are contemplated for securing the inner and outer tracks together for shipment and/or installation purposes but removed after installation to permit relative longitudinal movement. Such mechanisms include toggle bolts and other known devices.

Figure 3:
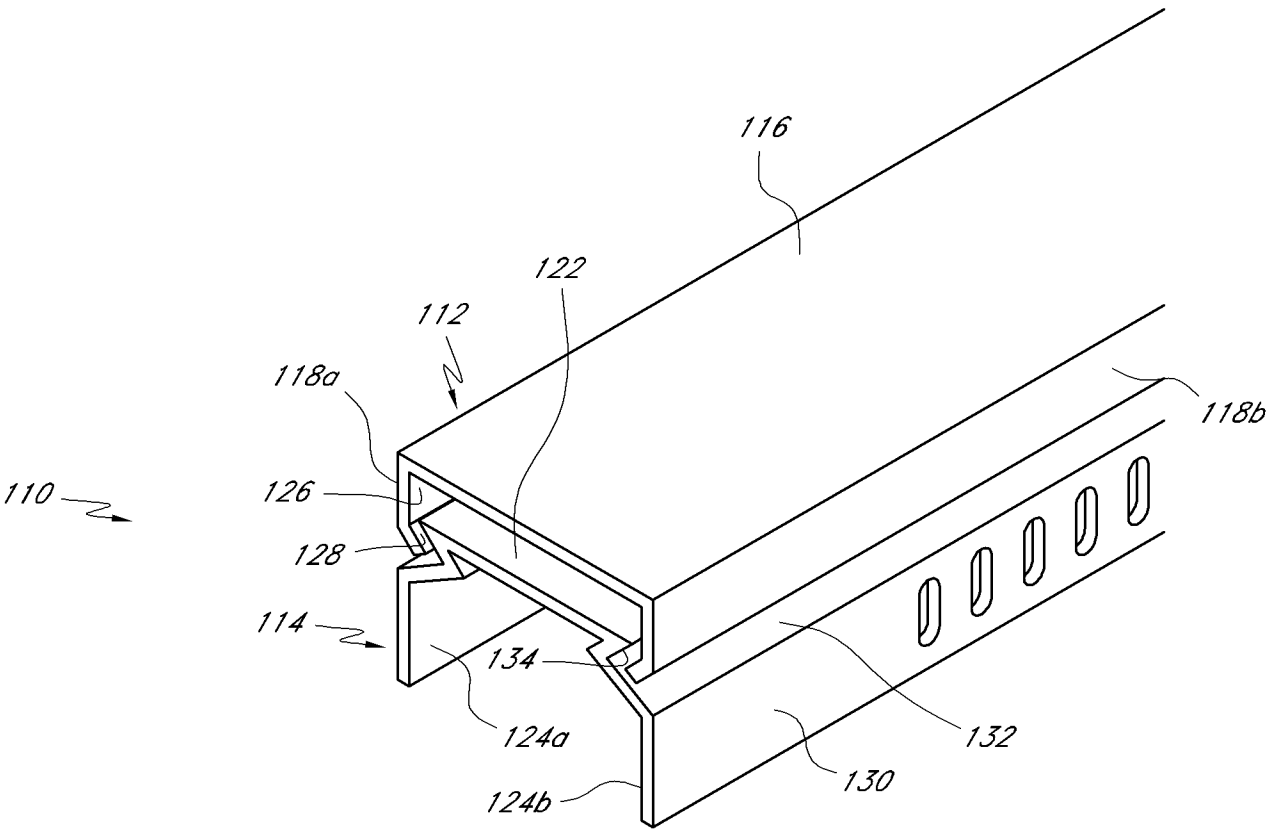
FIG. 3 illustrates a perspective schematic view of another embodiment of the two-piece track assembly.
Figure 4:
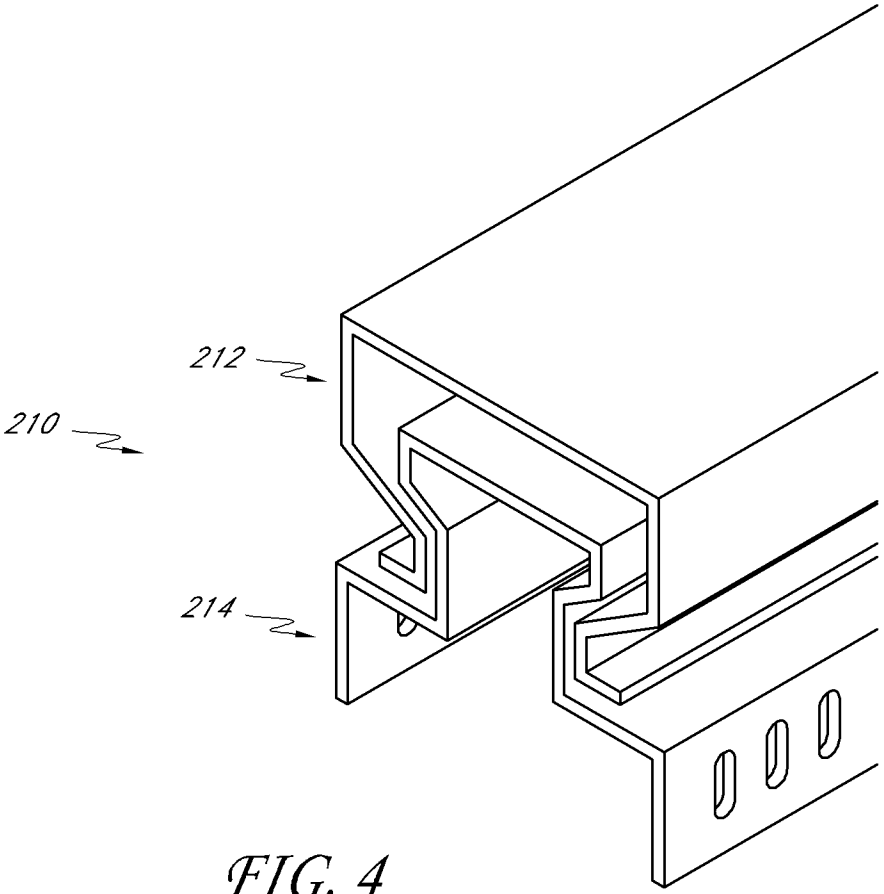
FIG. 4 illustrates a perspective schematic view of another embodiment of the two-piece track assembly.
Figure 5:
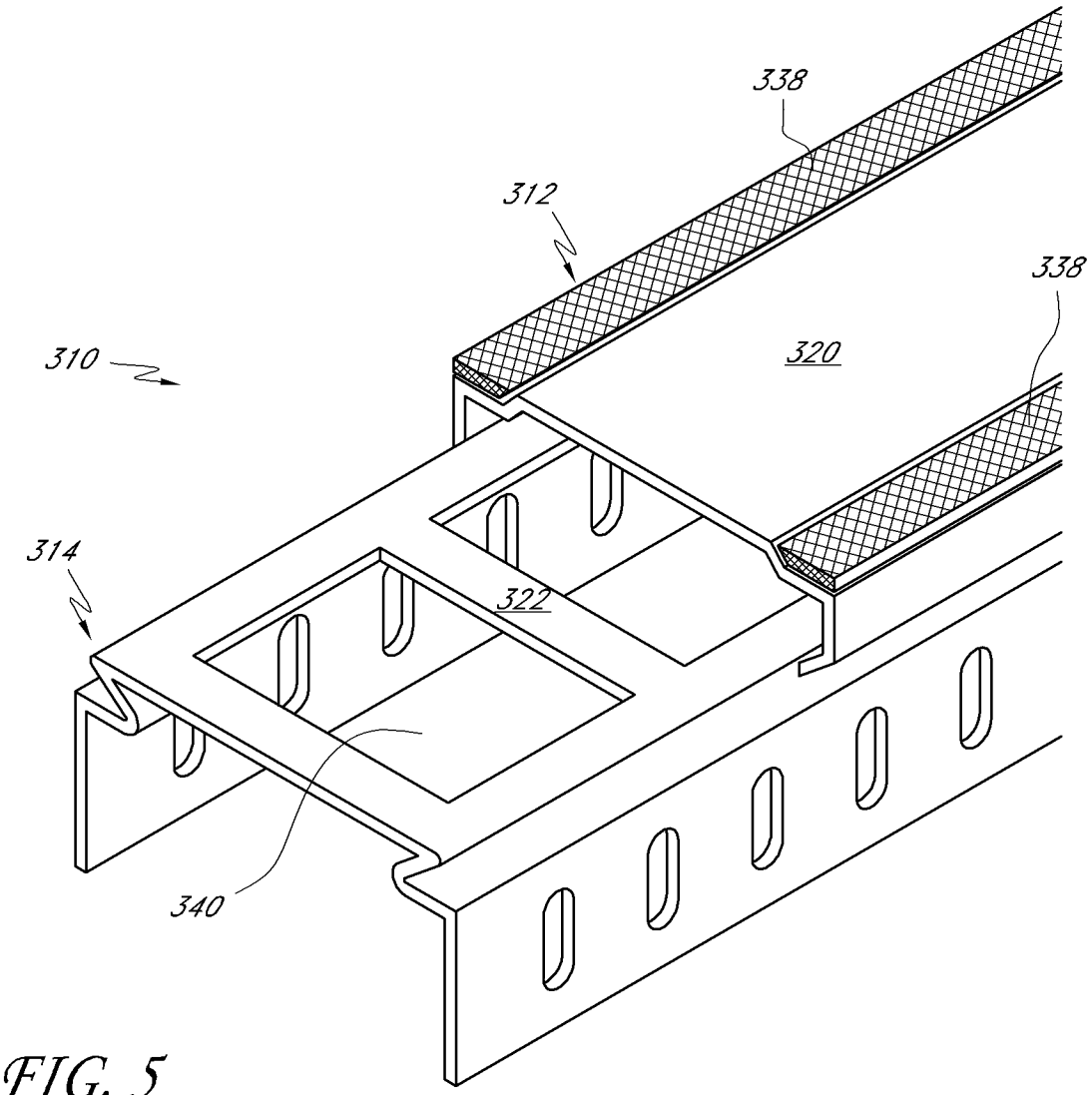
FIG. 5 illustrates a perspective schematic view of another embodiment of the two-piece track assembly.

It is contemplated that the inner and outer tracks may be configured in one of a large number of mating configurations that permit relative longitudinal movement of the inner track within the outer track and yet preserve the assembly intact. Examples of other configurations are shown in FIGS. 3-5. In each of these examples, the side flanges comprises multiple angled surfaces that permit mating of the inner and outer tracks in such a way as to restrain the two tracks from being easily pulled apart once nested. By way of example, referring to FIG. 3, an alternative embodiment of a two-piece nested track assembly 110 comprises an outer track 112 and inner track 114. The outer track 112 comprises a web 116 and side flanges 118*a* and 118*b*; the inner track 114 comprises a web 122 and side flanges 124*a* and 124*b*. Side flange 118 comprises a first surface 126 and a second surface 128 angled with respect to first surface 128. Correspondingly, side flange 124 comprises a first surface 130, a second surface 132, and a third surface 134. With such an arrangement, the inner track 114 may be nested within outer track 112 so as to restrain the tracks from being easily pulled apart. They may be shipped as discrete track pieces and snapped in place as a nested assembly. Similarly, FIG. 4 also reflects a plurality of surfaces in the corresponding flanges of outer and inner tracks 212 and 214 so that a mating nested arrangement can be made to make it more difficult to pull the tracks apart.

Referring to FIG. 5, another embodiment of a nested track assembly 310 can include an outer track 312 and inner track 314. The outer track 312 can include a strip or strips of intumescent material 338 attached along portions of the web 320 of outer track 312. In use, the intumescent material 338 can act in helping to prevent fire, smoke, or other debris from moving past the track assembly 310. Additionally, the inner track 314 can include an opening or openings 340 along the web 322 of inner track 314. By incorporating openings 340 in the inner track 314, the weight of inner track 314 can be reduced while still maintaining the structural stability of the track assembly 310.

Figure 6:
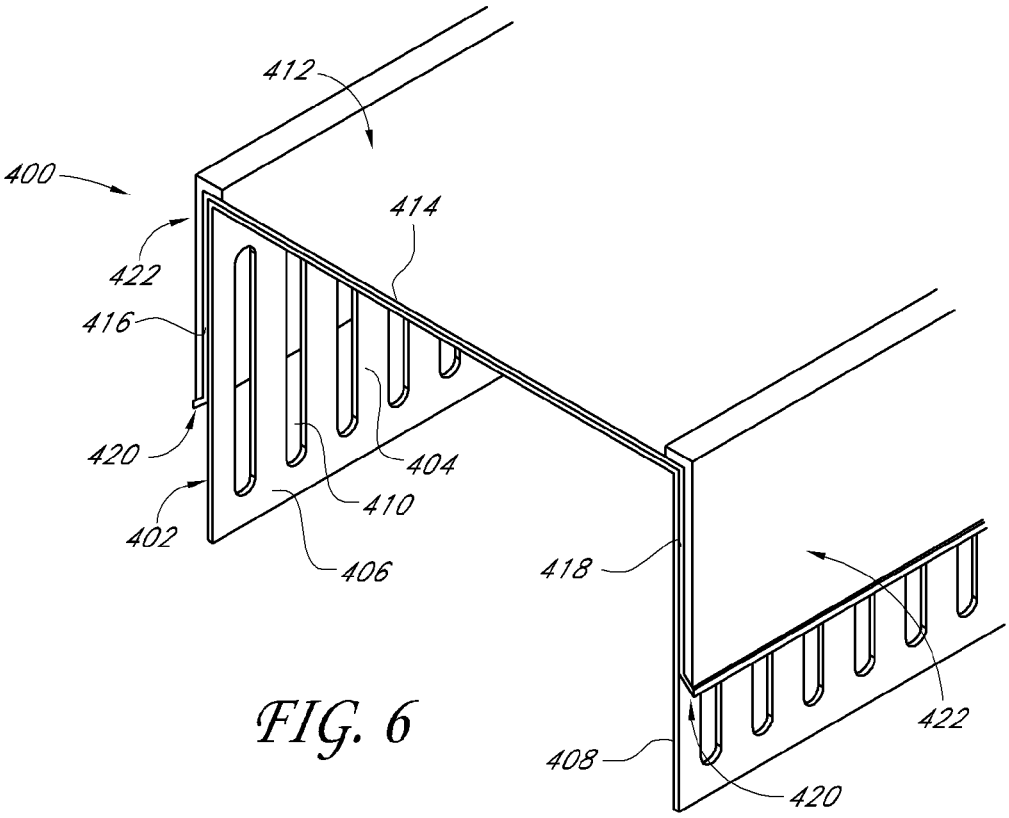
FIG. 6 is a perspective view of another embodiment of a two-piece track assembly including a header track and a receiver channel.
Figure 7:
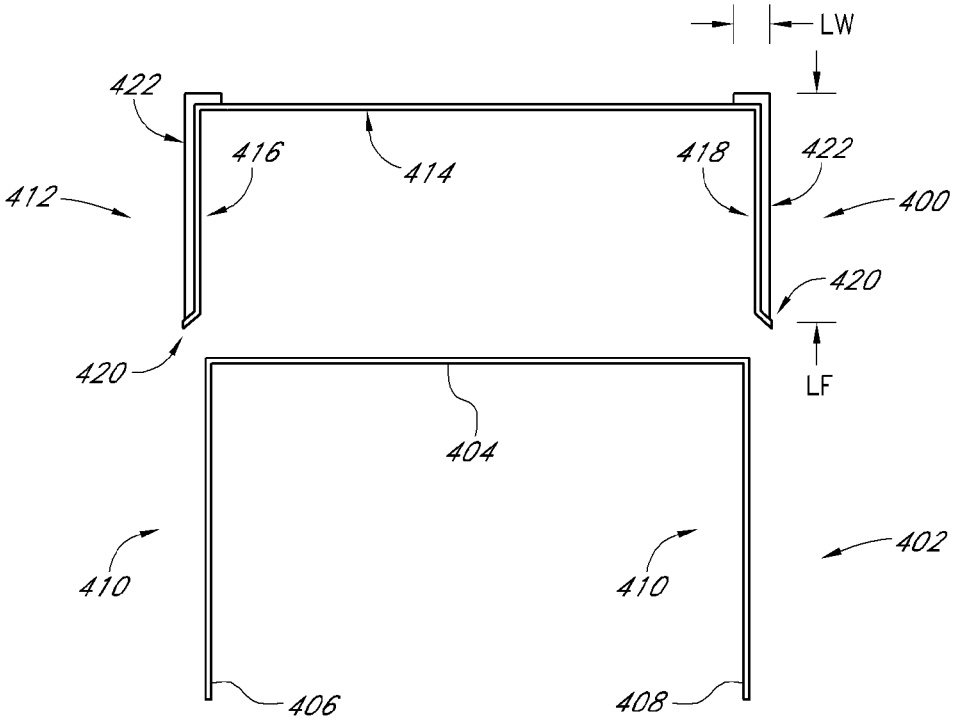
FIG. 7 is a cross-sectional view of the two-piece track assembly of FIG. 6 with the header track and receiver channel separated from one another.
Figure 8:
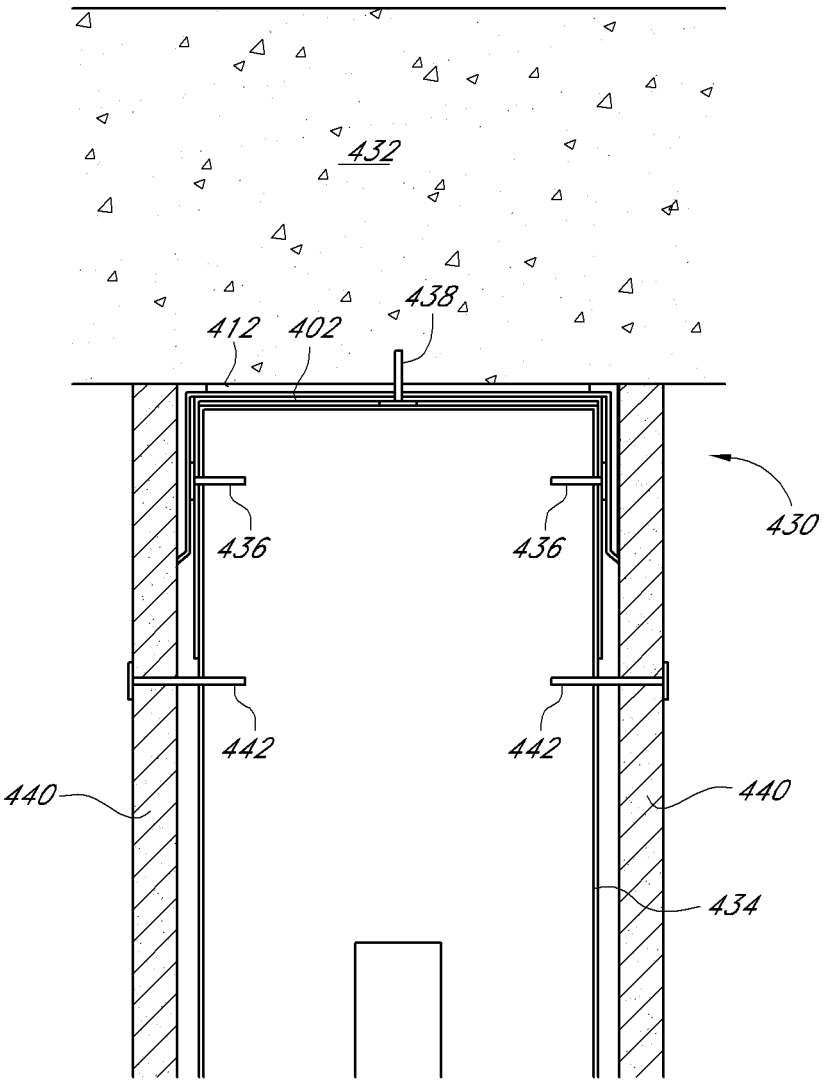
FIG. 8 is a cross-sectional view of a dynamic head-of-wall arrangement utilizing the two-piece track assembly of FIG. 6.
Figure 9:
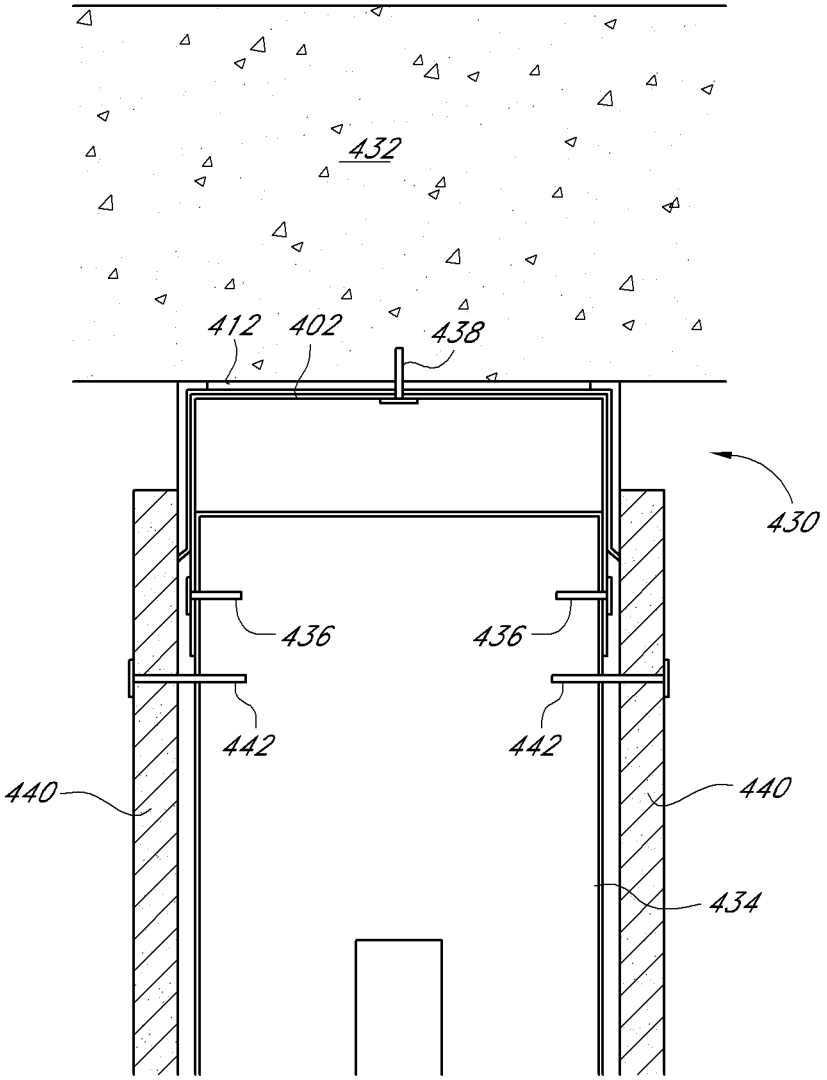
FIG. 9 is a cross-sectional view of the dynamic head-of-wall arrangement of FIG. 8 in a position with the head-of-wall gap open.

FIGS. 6 and 7 illustrate another two-piece track assembly 400. FIGS. 8 and 9 illustrate the two-piece track assembly 400 incorporated into a head-of-wall assembly. The two-piece track assembly 400 can be used in a variety of perimeter wall gap applications, including gaps at the top of a wall ("head-of-wall" gap), gaps at the bottom of a wall, and gaps at the side of a wall. The two-piece track assembly 400 can be used in interior or exterior wall applications. However, the illustrated two-piece track assembly 400 is well-suited for interior wall applications and is shown in an interior wall environment. The two-piece track assembly 400 is shown in the context of a dynamic head-of-wall assembly, but can also be employed in a static head-of-wall assembly, as discussed below.

With reference to FIGS. 6 and 7, the two-piece track assembly 400 includes a first track member, or first track 402. The illustrated first track 402 is a header track intended to be coupled to an overhead structure and receive upper ends of a plurality of wall studs. However, the first track 402 could also be a bottom track or a wall stud. The illustrated header track 402 includes a web 404, a first flange 406 and a second flange 408. The first flange 406 and second flange 408 extend downwardly from opposing first and second side edges of the web 404. Preferably, a substantial portion or the entirety of each of the first flange 406 and second flange 408 is planar. Accordingly, the header track 402 is substantially U-shaped in cross-section. In some arrangements, the first flange 406 and the second flange 408 can include non-planar portions, such as the upper portions of the second tracks 14 illustrated in FIGS. 1-5 or lengthwise-extending elongated protrusion(s) for the wallboard to rest against.

Preferably, each of the first flange 406 and the second flange 408 include a plurality of elongated slots 410 that extend in a vertical direction, or in a direction from a free end of the flange 406, 408 toward the web 404 and perpendicular to a length direction of the track 400. The centerlines of adjacent slots 410 are spaced from one another along a length of the track 400 by a distance, such as one inch, in one embodiment. However, other offset distances could be provided, depending on the desired application. Preferably, the slots 410 are linear in shape and sized to receive and guide a fastener that couples a stud to the header track 400, as described below. The slots 410 allow relative movement between the header track 400 and the studs. The linear shape of the slots 410 constrains the fasteners to substantially vertical movement.

The two-piece track assembly 400 also includes a second track 412, which is also referred to as a receiver channel. The receiver channel 412 includes a web 414, a first flange 416 and a second flange 418. The first flange 416 and the second flange 418 each extend downwardly from opposing first and second side edges of the web 414. Preferably, a substantial portion or the entirety of each of the first flange 416 and second flange 418 is planar. Accordingly, the receiver channel 412 is substantially U-shaped in cross-section. However, in another arrangement, the receiver channel 412 could be provided in two pieces with the first flange 416 and a portion of the web 414 as one piece and the second flange 418 and portion of the web 414 as a second piece. Each piece of the receiver channel 412 could be separately attached to the first track 402 and/or the adjacent support structure.

Preferably, the free ends of each of the first flange 416 and the second flange 418 form a kick-out 420. The kick-out 420 extends outwardly from the remainder of the flange 416, 418 in a direction away from the web 414 (and away from the header track 402 when the two-piece track assembly 400 is assembled). The illustrated kick-out 420 is an outwardly-bent end portion of the flange 416, 418, which is oriented at an oblique angle relative to the remaining, preferably planar, portion of the flange 416, 418. As described further below, the kick-out 420 functions as a lead-in surface for the fasteners that pass through the slots 410 of the header track 402 when the heads of the fasteners move toward the top of the slots 410 and in between the flanges 416, 418 of the receiver channel 412 and the flanges 406, 408 of the header track 402. However, the kick-out 420 can be otherwise shaped if desired, depending on the intended application and/or desired functionality. For example, the kick-out 420 can be configured to contact the wallboard of an associated wall assembly to assist in creating a seal between the receiver channel 412 and the wallboard or to inhibit damage to the fire-resistant material on the receiver channel 412, as described below. In one arrangement, the kick-out 420 extends outwardly less than about ¼ inch, less than about ⅛ inch or less than about 1/16 inch.

The illustrated receiver channel 412 is a fire-rated channel and includes a fire-resistant material arranged to seal the head-of-wall gap at which the two-piece track assembly 400 is installed. Preferably, the fire-resistant material is an intumescent material strip 422, such as an adhesive intumescent tape. The intumescent strip 422 is made with a material that expands in response to elevated heat or fire to create a fire-blocking char. On suitable material is marketed as BlazeSeal™ from Rectorseal of Houston, Tex. Other suitable intumescent materials are available from Hilti Corporation, Specified Technologies, Inc., or Grace Construction Products. The intumescent material expands to many times (e.g., up to 35 times or more) its original size when exposed to sufficient heat (e.g., 350 degrees Fahrenheit. Thus, intumescent materials are used as a fire block because the expanding material tends to fill gaps. Once expanded, the intumescent material is resistant to smoke, heat and fire and inhibits fire from passing through the head-of-wall. It is understood that the term intumescent strip 422 is used for convenience and that the term is to be interpreted to cover other expandable fire-resistant materials as well, such as intumescent paints (e.g., spray-on) or fire-rated dry mix products, unless otherwise indicated. The intumescent strip 422 can have any suitable thickness that provides a sufficient volume of intumescent material to create an effective fire block, while having small enough dimensions to be accommodated in a wall assembly. That is, preferably, the intumescent material strips 422 do not cause unsightly protrusions or humps in the wall from excessive build-up of material. In one arrangement, the thickness of the intumescent strip 422 is between about 1/16 (0.0625) inches and ⅛ (0.125) inches, or between about 0.065 inches and 0.090 inches. One preferred thickness is about 0.075 inches. The kick-out 420 can extend outwardly a distance greater than the thickness of the intumescent strip 422, a distance approximately equal to the thickness of the intumescent strip 422 or a distance less than the thickness of the intumescent strip 422. The size of the kick-out 420 can be selected based on whether it is desirable for the wall board material to contact the kick-out 420 (e.g., to create a seal or protect the intumescent strip 422), the intumescent strip 422, or both the kick-out 420 and the intumescent strip 422.

An intumescent strip 422 is positioned on at least one side of the receiver channel 412 and, preferably, on each side of the receiver channel 412. The intumescent strip 422 preferably is positioned on one or both of the flange 416, 418 and the web 414. In the illustrated arrangement, the intumescent strip 422 is attached on both the flange 416 and the web 414 on one side of the receiver channel 412 and on both the flange 418 and the web 414 on the other side of the receiver channel 412. Preferably, the intumescent strip 422 covers a substantial entirety of the flange 416, 418 and also extends beyond the web 414. That is, each intumescent strip 422 preferably extends from the kick-out 420 of the respective flange 416, 418 to the web 414 and beyond the web 414. Such an arrangement permits the intumescent strip 422 to contact the ceiling or other overhead support structure to create an air seal at the head-of-wall. Preferably, the upper edge of the intumescent strip 422 wraps around the corner of the receiver channel 412 and is attached to the web 414. Such an arrangement causes the intumescent strip 422 to be pinched between the receiver channel 412 and the ceiling or other overhead support structure to assist in keeping the intumescent strip 422 in place when exposed to elevated heat, which may cause failure of an adhesive that secures the intumescent strip 422 to the receiver channel 412. However, although less preferred, the upper edge of the intumescent strip 422 could simply extend beyond (above, in the illustrated arrangement) the web 414 without being attached to the web 414.

Preferably, a relatively small amount of the intumescent strip 422 is positioned on the web 414 relative to the amount positioned on the flange 416, 418. For example, the intumescent strip 422 has a width, which in cross-section can be viewed as a length. Preferably, a length $L_F$ of the intumescent strip 422 on the flange 416, 418 is at least about 3 times the length $L_W$ of the intumescent strip 422 on the web 414. In one arrangement, the length $L_F$ of the intumescent strip 422 on the flange 416, 418 is at least about 5 times the length $L_W$ of the intumescent strip 422 on the web 414. In another arrangement, the length $L_F$ of the intumescent strip 422 on the flange 416, 418 is at least about 10 times the length $L_W$ of the intumescent strip 422 on the web 414. Preferably, the length $L_F$ of the intumescent strip 422 on the flange 416, 418 is between about ½ inches and 1½ inches and the length $L_W$ of the intumescent strip 422 on the web 414 is between about ⅛ inches and ½ inches. In one preferred arrangement, the length $L_F$ of the intumescent strip 422 on the flange 416, 418 is about ¾ inches and the length $L_W$ of the intumescent strip 422 on the web 414 is about ¼ inches.

In the illustrated arrangement, the flanges 416, 418 of the receiver channel 412 are shorter than the flanges 406, 408 of the header track 402. The flanges 416, 418 of the receiver track 412 can cover an upper portion of the slots 410 of the header track 402. Preferably, at least a lower portion of the slots 410 are exposed or left uncovered by the flanges 416, 418 of the receiver track 412. In one arrangement, the length of the flanges 416, 418 are about one-half of the length of the flanges 406, 408. The flanges 416, 418 can have a length of between about ¾ inches and 3 inches, or between about 1 and 2 inches. In one arrangement, the flanges 416, 418 have a length of about 1½ inches or 1¼ inches. The flanges 406, 408 of the header track 402 can be any suitable length. For example, the flanges 406, 408 can be between about 2 and 4 inches in length, with specific lengths of about 2½ inches, 3 inches, 3¼ inches and 3½ inches, among others.

The web 404 of the header track 402 can be any suitable width. For example, the web 404 can have a width between about 2½ and 10 inches, with specific lengths of about 3.5 inches, 4 inches, 5.5 inches, 6 inches and 7.5 inches, among others. Preferably, the width of the web 414 of the receiver channel 412 corresponds to the width of the web 404 of the header track 402. Although, preferably, the web 414 of the receiver channel 412 will be slightly wider than the web 404 of the header track 402 so that the header track 402 can be received within, or nest within, the receiver channel 412. The web 414 preferably is wider than the web 404 at least by an amount equal to twice the wall thickness of the header track 402 to accommodate the combined thickness of the flanges 406 and 408. However, preferably, the web 414 is not significantly wider than the web 404 such that there is no significant gap between the flanges 406, 408 of the header track 402 and the flanges 416, 418 of the receiver channel 412. Preferably, the gap, if any, between the flanges 406 and 416 or 408 and 418 is less than about the size of a head of the fastener used to attach the wall studs to the header track 402. In one arrangement, the gap on either side is less than about ⅛ inches or less than about ¼ inches. However, in other arrangements, it may be desirable to provide a significant gap. For example, it may be desirable to provide an air gap between the flanges 406 and 416 and/or 408 and 418, such as to inhibit direct contact and, thus, direct transfer of heat between the flanges 406 and 416 and/or 408 and 418. Such a gap may be less than or equal to about 2 inches, less than or equal to about 1 inch or less than or equal to about ½ inch. If desired, a thermal break material can be positioned between any or all corresponding surfaces of the tracks 402, 412. The thermal break material can be applied to the inner surfaces of the receiver channel 412. The thermal break material can be a liquid applied material, or an adhesively applied sheet membrane material to provide thermal break insulation to slow down heat passage during a fire. Any suitable insulating materials can be used.

The header track 402 and the receiver channel 412 can be constructed of any suitable material by any suitable manufacturing process. For example, the header track 402 and receiver channel 412 can be constructed from a rigid, deformable sheet of material, such as a galvanized light-gauge steel. However, other suitable materials can also be used. The header track 402 and receiver channel 412 can be formed by a roll-forming process. However, other suitable processes, such as bending (e.g., with a press brake machine), can also be used. Preferably, the intumescent strip(s) 422 are applied during the manufacturing process. However, in some applications, the intumescent strip(s) 422 could be applied after manufacturing (e.g., at the worksite).

FIGS. 8 and 9 illustrate an upper portion of a wall assembly, or a head-of-wall assembly 430, incorporating the two-piece header track assembly 400 of FIGS. 6 and 7. The illustrated head-of-wall assembly 430 is a dynamic head-of-wall assembly, meaning that relative movement between the header track assembly 400 and the remainder of the wall is permitted. Such arrangements are intended to accommodate deflections caused by seismic events or moving overhead loads. FIG. 8 illustrates the head-of-wall assembly 430 in or near a position in which the deflection joint is closed, or the head-of-wall gap is reduced in size or minimized. FIG. 9 illustrates the head-of-wall assembly 430 in a position in which the deflection joint is open, or a head-of-wall gap exists. The two-piece header track assembly 400 can also be employed in static head-of-wall assemblies.

The wall assembly of FIGS. 8 and 9 extends in a vertical direction between a floor, or other lower support structure (not shown), and a ceiling 432, or other overhead support structure. The ceiling 432 can be of any suitable arrangement, including a fluted pan deck that supports a concrete layer. The wall assembly includes a bottom track (not shown) that is secured to the floor. A plurality of studs 434 have lower ends supported within and secured to the bottom track. The studs 434 are spaced from one another at a desired interval along a length of the bottom track. The studs 434 extend upward in a vertical direction from the bottom track to the two-piece header track assembly 400. The upper ends of the studs 434 are received within the header track 402 and, preferably, spaced from the web 404 of the header track 402 (FIG. 9) in a neutral position or an unloaded condition of the ceiling 432. For each stud 434, a first fastener 436 (e.g., a threaded framing screw) is passed through a corresponding slot 410 of the flange 406 and into the stud 434 and a second fastener 436 is passed through a corresponding slot 410 of the flange 408 and into the stud 434. Preferably, the fasteners 436 are positioned at or near the center of the slots 410 to permit deflection movement in either an up or down direction.

The two-piece header track assembly 400 is secured to the ceiling 432 in any suitable manner, such as by a plurality of suitable fasteners 438. In some arrangements, it is preferred that the header track 402 and the receiver channel 412 are both secured to the ceiling 432. For example, each of the plurality of fasteners 436 can pass through the webs 404 and 414 of the header track 402 and receiver channel 412, respectively, to secure both tracks 402 and 412 to the ceiling 432. The header track 402 and the receiver channel 412 can be secured to the ceiling 432 separately from one another (e.g., using separate fasteners) or simultaneously. In one arrangement, the receiver channel 412 is secured to the ceiling 432 first and then the header track 402 is nested within the receiver channel 412 and secured to the ceiling 432, alone or as part of a wall assembly. In another arrangement, the receiver channel 412 and header track 402 are secured to the ceiling 432 at the same time utilizing the same fasteners 438. Thus, in such an arrangement, relative longitudinal (or "drift") movement of the tracks 402 and 412 is minimized or prevented. However, if drift movement is desired, the receiver channel 412 can be fixedly secured to the ceiling 432 and the header track 402 can be free floating within the receiver channel 412 or otherwise secured to allow some relative drift movement, such as in any manner described above with reference to FIGS. 1-5. As illustrated, preferably, a portion of the intumescent strip 422 is pinched between the ceiling 432 and the receiver channel 412. As described above, such an arrangement assists in keeping the intumescent strip 422 in place over time and/or in the event of elevated heat or fire that causes failure of the adhesive that secures the intumescent strip 422 to the receiver channel 412.

One or more pieces of wallboard 440 are attached to one or both sides of the studs 434 by a plurality of suitable fasteners, such as drywall screws 442. Preferably, the uppermost drywall screws 442 are positioned close to the header track 402 but spaced sufficiently therefrom so as to not inhibit complete upward movement of the studs 434 relative to the header track 402.

As illustrated, preferably, in a neutral or unloaded condition, the heads of the fasteners 436 securing the studs 434 to the header track 402 are positioned below the lowermost ends, or free ends, of the flanges 416, 418 of the receiver channel 412. Preferably, in such a position, an upper end of the wallboard 440 rests against the intumescent strip 442 and/or the kick-out 420. When the wall is deflected such that the studs 434 move upwardly towards or to a closed position of the deflection gap (FIG. 8), the heads of the fasteners 436 may enter in between the flanges 406, 408 of the header track 402 and the flanges 416, 418 of the receiver channel 412. If the gap between the flanges 406 and 416 and/or 408 and 418 is less than the width of the head of the fastener 436, the flanges 416 and/or 418 of the receiver channel 412 may flex or deflect outwardly to accommodate the heads of the fasteners 436. The shape and/or angle of the kick-out 420 can facilitate the entry of the heads of the fasteners 436 in between the flanges 406 and 416 and/or 408 and 418 without getting hung up on the flanges 416 and/or 418.

Figure 10:
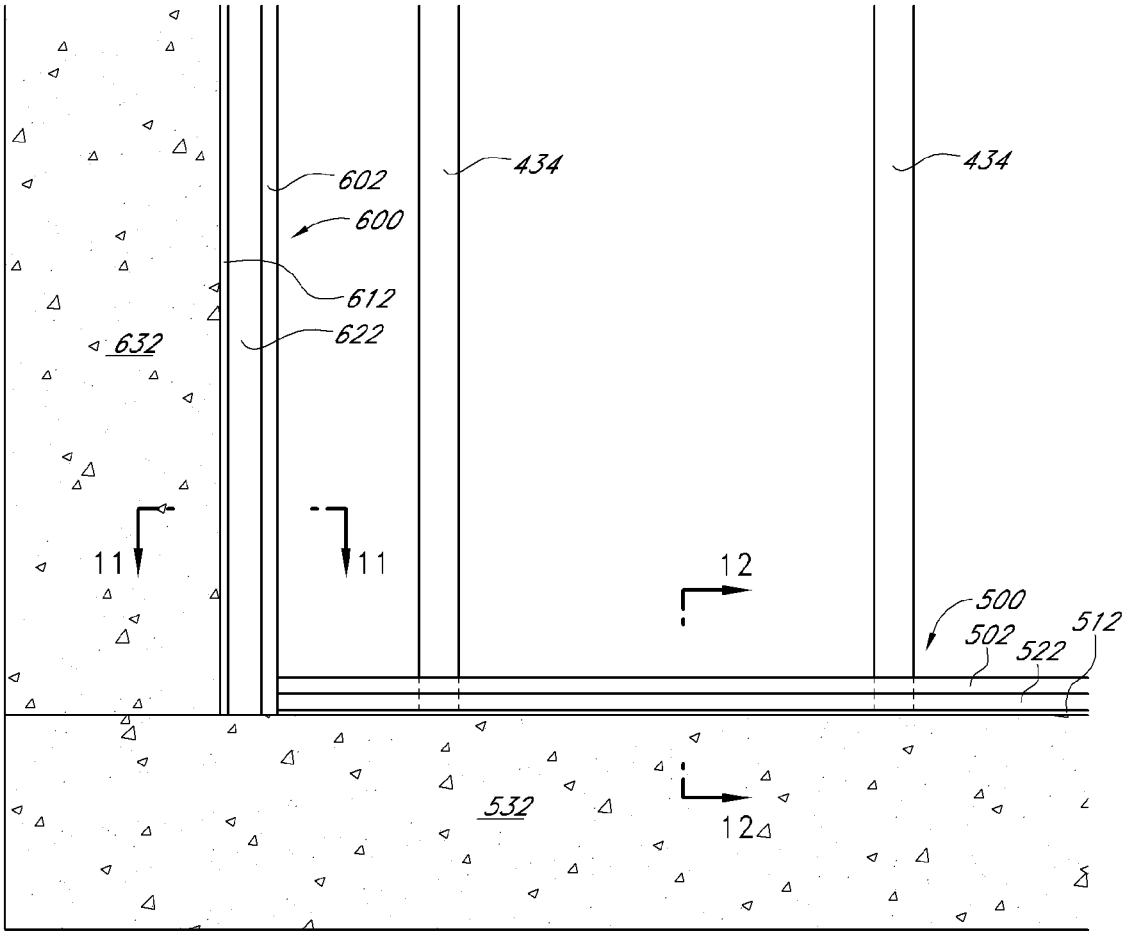
FIG. 10 is a side view of a bottom gap and side gap of a wall, wherein each of the bottom gap and side gap arrangements utilize a two-piece track assembly similar to the assembly of FIG. 6.
Figure 11:
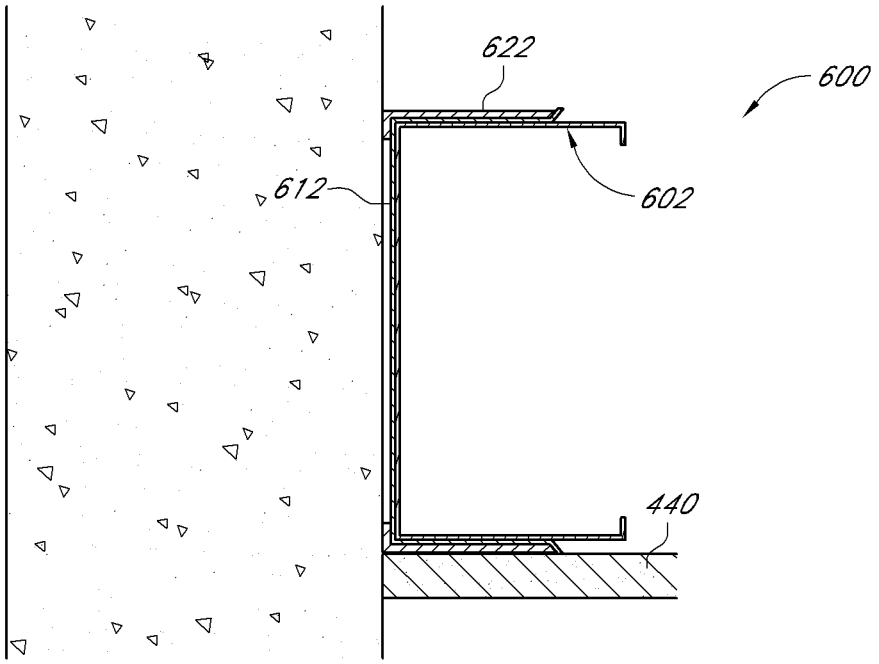
FIG. 11 is a cross-sectional view of the side gap of the wall of FIG. 10 taken along line 11-11 of FIG. 10.
Figure 12:
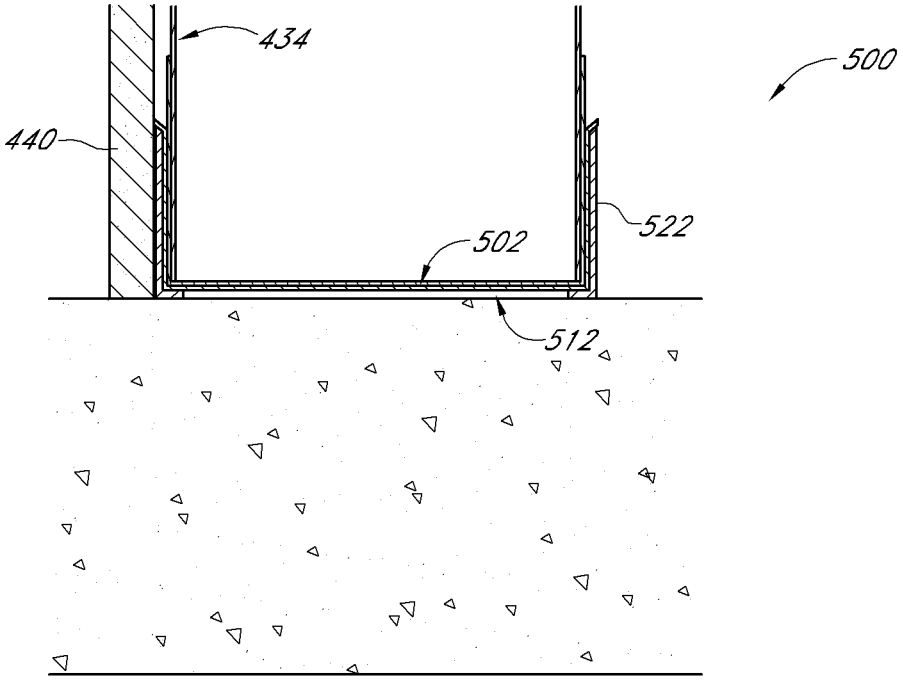
FIG. 12 is a cross-sectional view of the bottom gap of the wall of FIG. 10 taken along line 12-12 of FIG. 10.

FIGS. 10-12 illustrate a wall assembly utilizing a first two-piece track assembly 500 at a gap at the bottom of the wall assembly and a second two-piece track assembly 600 at a gap at the side of the wall assembly. Preferably, each two-piece track assembly 500, 600 is similar to the two-piece track assembly 400 described above. In particular, preferably, each two-piece track assembly 500, 600 creates a fire-resistant structure at the respective wall gap.

The first two-piece track assembly 500 includes a sill plate, first track, or bottom track 502, and a second track, or receiver channel 512. The bottom track 502 preferably is substantially similar to the header track 402 described above. However, preferably, the bottom track 502 does not include slots on the side flanges (such as slots 410 of the header track 402) because relative movement between the studs 434 and the bottom track 502 is typically not desired. The receiver channel 512 preferably is identical or substantially identical to the receiver channel 412 described above. The bottom track 502 is snugly nested within the receiver channel 512. The combined bottom track 502 and receiver channel 512 (the two-piece track assembly 500) is secured to a lower support structure, such as a floor 532, which can also function as a ceiling of a lower level of the building. The two-piece track assembly 500 can be secured to the floor 532 with a plurality of suitable fasteners (not shown) similar to the fasteners 438 described above. The receiver channel 512 includes one or more intumescent strips 522, which expand in response to elevated heat or fire to create a fire block at the gap at the bottom of the wall assembly. The particular structure and arrangement of the intumescent strips 522 can be identical to the arrangements discussed above with respect to the receiver channel 412. With reference to FIG. 12, one or more pieces of wallboard 440 can be secured to one or both sides of the studs 434

Similarly, the second two-piece track assembly 600 includes a first track, or stud 602, and a second track, or receiver channel 612. The stud 602 preferably is substantially similar to the studs 434 described above. Thus, with reference to FIG. 11, the stud 602 can be C-shaped in cross-section. The stud 602 includes a web and flanges that create a U-shaped portion. In addition, the free ends of the flanges can also include return leg portions that extend inwardly toward one another to create the C-shape. However, other suitable stud shapes and/or types, including wood studs, can also be used. Thus, the assemblies described herein are referred for convenience as "two-piece track" assemblies; however, it is not necessary that each assembly includes two "tracks." Therefore, assemblies incorporating a wood stud (header or footer) can be included within the scope of a "two-piece track" assembly, unless specifically excluded. The receiver channel 612 preferably is identical or substantially identical to the receiver channels 412, 512 described above. The stud 602 is snugly nested within the receiver channel 612. The combined stud 602 and receiver channel 612 (the two-piece track assembly 600) is secured to a side support structure, such as a wall 632. The two-piece track assembly 600 can be secured to the side wall 632 with a plurality of suitable fasteners (not shown) similar to the fasteners 438 described above. The receiver channel 612 includes one or more intumescent strips 622, which expand in response to elevated heat or fire to create a fire block at the gap at the side of the wall assembly.

The described two-piece track assemblies 400, 500 and 600 provide convenient and adaptable fire block structures for a variety of linear wall gap applications, which in at least some embodiments permit the creation of a fire rated joint according to UL 2079. The separate receiver channels 412, 512, 612 include fire-retardant materials (e.g., intumescent material strips) secured (e.g., adhesively attached or bonded) to appropriate locations on the channels 412, 512, 612 and can be used with a variety of headers, footers (bottom tracks or sill plates) and studs to create a customizable assembly. Thus, one particular type of channel 412, 512, 612 can be combined with multiple sizes or types of base tracks, headers, sill plates or studs to result a large number of possible combinations. The receiver channels 412, 512, 612 can be configured for use with commonly-available tracks, headers, sill plates or studs, in addition to customized tracks, headers, sill plates or studs specifically designed for use with the receiver channels 412, 512, 612. Thus, the advantages of the described systems can be applied to existing wall assemblies. Therefore, the channels 412, 512, 612 can be stocked in bulk and used as needed with an appropriate framing component.

Figure 13:
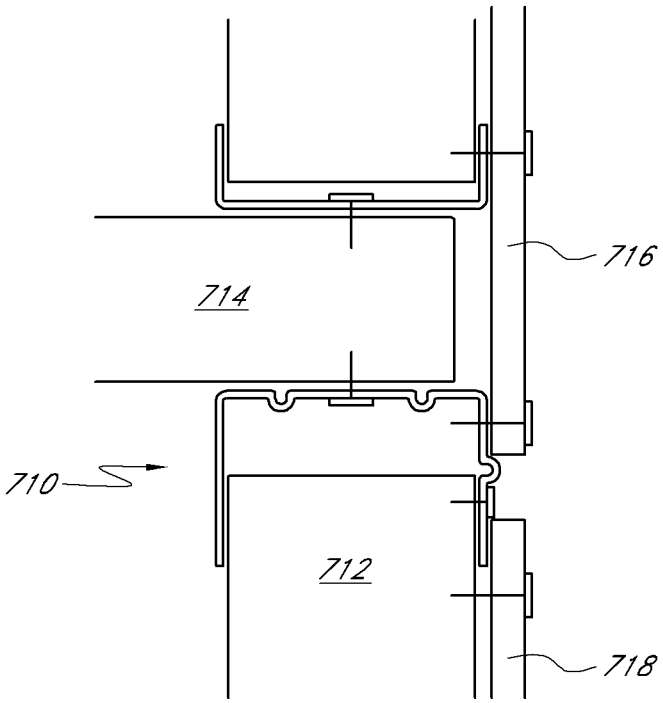
FIG. 13 illustrates a cross-sectional view of the exterior portion of a building, including a slotted track, a floor slab, a wall stud, and two pieces of exterior sheathing.

Referring to FIG. 13, the inventive slotted track 710 can be used with a wall stud 712, a floor slab 714, and two pieces of exterior sheathing elements 716 and 718. In use, the slotted track 710 is connected to the bottom surface of floor slab 714 by an acceptable fastening means. In the illustrated arrangement, the floor slab 714 is solid; however, it is also possible to use the track 710 with other types of floors (e.g., fluted floor decks) and other suitable structures, as well. The two exterior sheathing elements 716 and 718 are positioned and attached alongside the exterior portion of the slotted track 710 such that a lower end of upper sheathing element 716 ends just prior to a plurality of slots (not shown in FIG. 13) along a portion of one flange of the slotted track 710.

Figure 14:
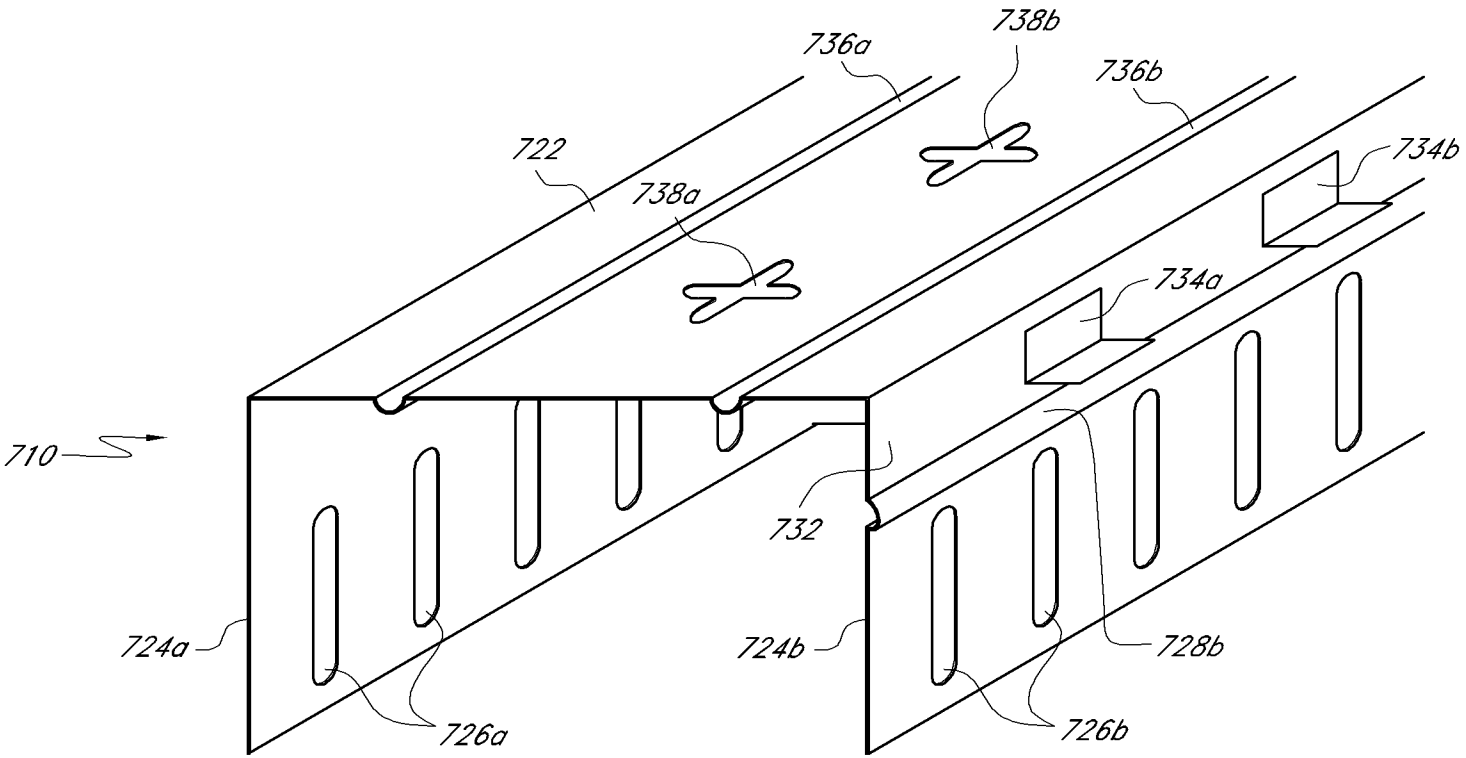
FIG. 14 illustrates a perspective view of an embodiment of the slotted track of FIG. 1, further comprising a plurality of tabs.

Referring to FIG. 14, an embodiment of the slotted track 710 comprises a web 722, two flanges **724*a* and 724*b*, and a plurality of slots 726*a* and 726*b* along each of the flanges 724*a* and 724*b*. These slots 726*a* and 726*b* are configured to allow the shaft portion of a fastener, such as a threaded fastener, to pass through the slots 726*a* and 726*b* and into the stud 712 to permit attachment of the slotted track 710 to the wall stud 712. The slots 726*a* and 726*b* also generally allow for orthogonal movement of the fastener within the slots 726*a* and 726*b* and, thus, movement of the wall stud 712 relative to the slotted track 710. As discussed above, in those areas of the world where earthquakes are common, movement of the wall studs is important. If the wall studs are rigidly attached to the slotted track and not allowed to move freely in at least one direction, the stability of the wall and the building might be compromised. Thus, with the plurality of slots 726***a* and 726*b* provided in the present slotted track 710, the wall stud 712 is free to move.

In some embodiments, an elongate reinforcing rib 728*b* may be provided along flange 724*b*. In some embodiments, the rib can include a groove along its back side. The rib 728*b* protrudes outwards, and provides added stability to the slotted track 710. In other embodiments, the rib can protrude inwardly. In the embodiment of FIG. 14, one rib is used on flange 724*b*. However, more than one rib can also be used. A rib or ribs can be used on flange 724*a* as well to provide added stability. Additionally, a sheathing attachment area 732 is located above and adjacent the rib 728*b*. The sheathing attachment area 732 is large enough to attach sheathing elements as well as provide added stability to the slotted track 710.

During installation, the sheathing element 716 can be placed against the sheathing attachment area 732 such that the sheathing element's lower portion rests on top of the rib 728*b*. The rib 728*b* thus helps to align the sheathing element 716 relative to the track 710 so that sheathing element 716 does not cover a portion of the plurality of slots 726*b* and prevent the generally orthogonal movement of the wall stud 712.

Still referring to FIG. 14, the slotted track 710 may further (or alternatively) comprise tabs 734*a* and 734*b*. The tabs 734*a* and 734*b* can be made integral with the slotted track 710 or separately applied to the slotted track 710 either mechanically or by other means. In at least one embodiment, the tabs 734*a* and 734*b* can be fold-down tabs. The tabs 734*a* and 734*b* can lock in place once they have folded down to a certain point or angle. For example, the tabs can have hinges (not shown) which only allow the tab to fold down 90 degrees. In at least one embodiment, the tab 734*a*, 734*b* may contact the rib 728*b* when folded such that the rib 728*b* provides some amount of support to the tab 734*a*, 734*b*. In yet other embodiments, the tabs 734*a* and 734*b* can include a lip or rib (not shown) for holding the sheathing element 716 in place while it is being attached. During installation of the sheathing elements, the tabs help to align the sheathing element 716 so that sheathing element 716 does not cover a portion of the plurality of slots 726*b* and prevent the generally orthogonal movement of the wall stud 712. While the present embodiment includes two tabs per standard sheet of sheathing element 716 (FIG. 13), additional embodiments can include other numbers of tabs. Furthermore, in at least one embodiment, the tabs can be spaced evenly along the sheathing attachment area 732 of slotted track 710.

The slotted track 710 may further comprise elongate reinforcing ribs 736*a* and 736*b* along the web 722. Ribs 736*a* and 736*b* provide added stability to the slotted track 710. Positioned between ribs 736*a* and 736*b*, and laterally positioned along the web 722 of slotted track 710, are second slots 738*a* and 738*b*. The second slots can be of various shapes, including but not limited to that of a cross slot. In at least one embodiment, the second slots 738*a* and 738*b* allow for drift and seismic movement of the track 710. While the present embodiment includes two second slots, additional embodiments can include other numbers of second slots.

Figure 15:
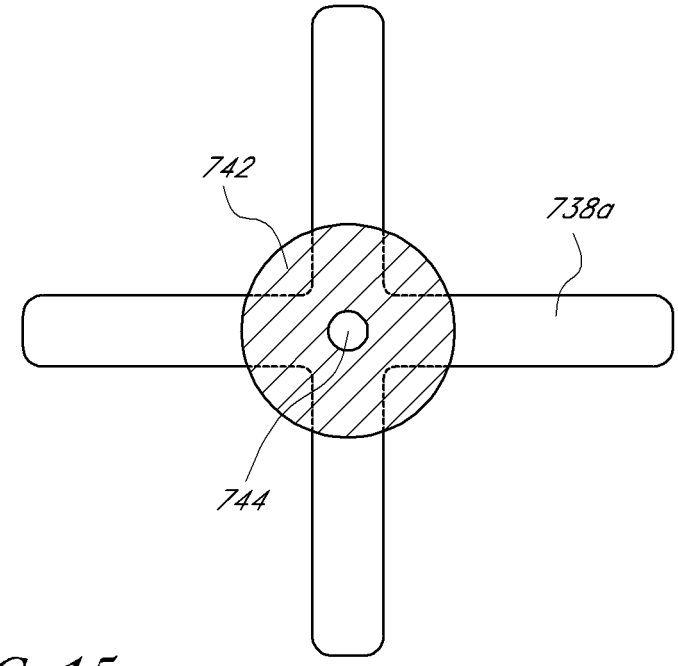
FIG. 15 illustrates a bottom plan view of a second slot located along the web of the slotted track of FIG. 14.
Figure 16:
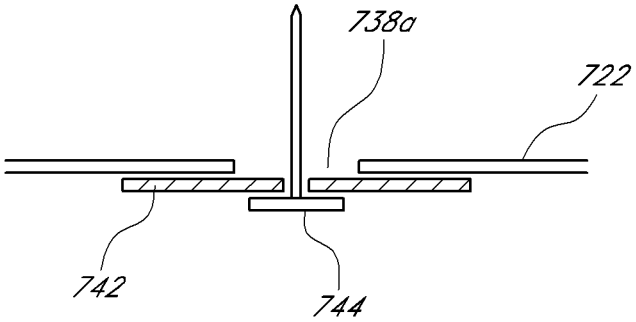
FIG. 16 illustrates a cross sectional view of the second slot of FIG. 15.

Referring to FIGS. 15 and 16, the second slot 738*a* can be used with a washer 742 and fastener 744, such as a threaded fastener, for example. The fastener 744 contacts the washer 742, which is positioned between the head of the fastener and the web 722 of slotted track 710, and fastens the slotted track 710 to the floor slab 714. Once fastened, the second slot 738*a* allows for drift and seismic movement of the slotted track 710 in multiple directions.

Figures 17, 18, 19:
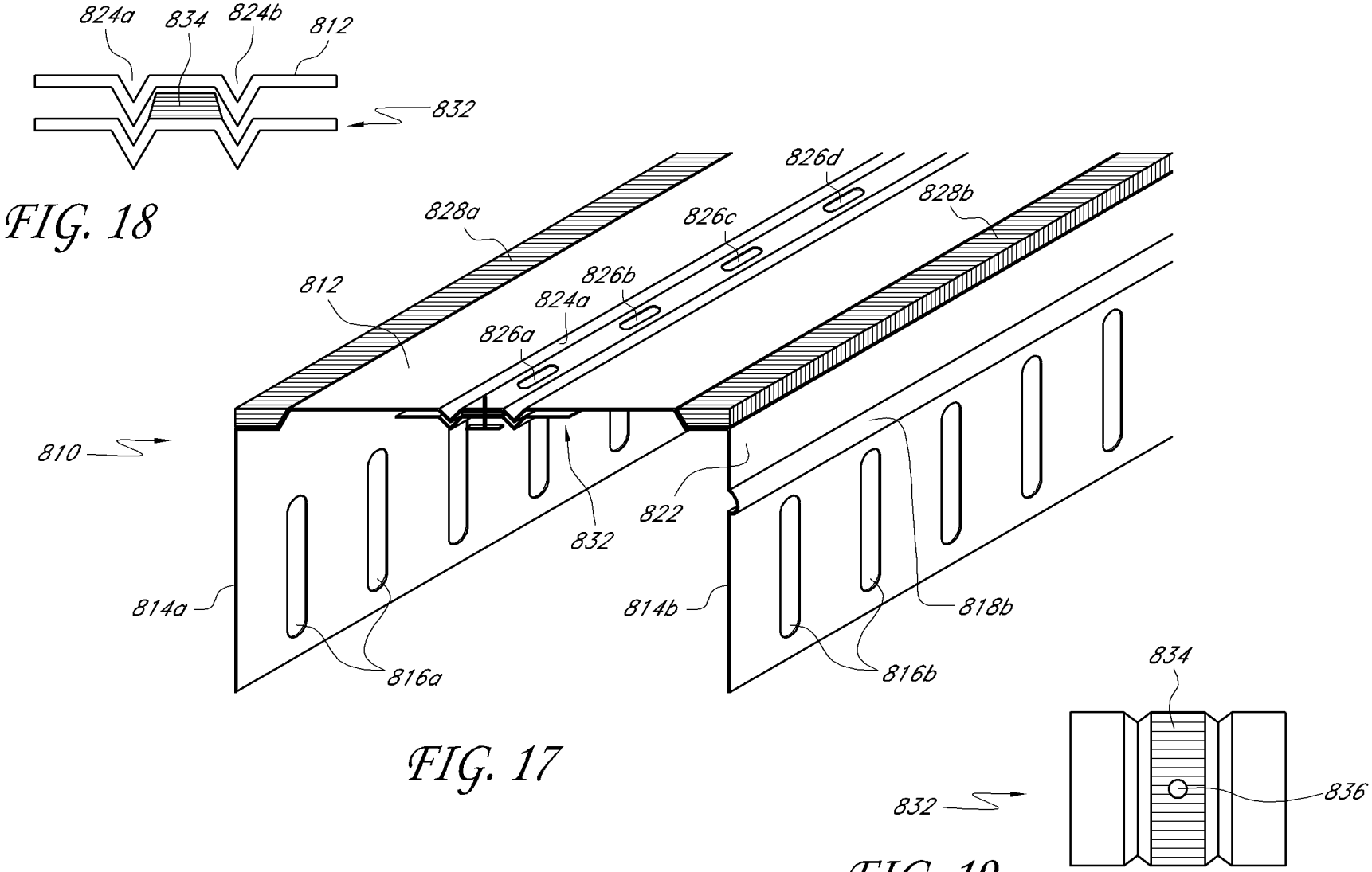
FIG. 17 illustrates a perspective view of an embodiment of a slotted track system, including a connection element.
FIG. 18 illustrates a cross sectional view of the connection element of FIG. 17.
FIG. 19 illustrates a top plan view of the connection element of FIG. 17.

Referring to FIG. 17, an embodiment of a slotted track system incorporates a slotted track 810. The slotted track 810 comprises a web 812, two flanges 814*a* and 814*b*, a plurality of slots 816*a* and 816*b*, a rib 818*b* along the flange, a sheathing attachment area 822, ribs 824*a* and 824*b* along the web, and second slots 826*a-d* located along the web. The slotted track 810 additionally comprises strips of intumescent material 828*a* and 828*b* attached to at least a portion of the web 812. In use, the intumescent material expands rapidly when heated, thus sealing off areas around the slotted track 810 and helping to prevent fire, smoke, or other debris from moving past or around the slotted track 810.

The slotted track system additionally incorporates a connection element 832. The connection element 832 can be applicable to both interior and exterior walls. In at least one embodiment, the connection element 832 can have a substantially W-shape. Referring to FIG. 18, the connection element 832 has a geometrical profile substantially similar to that of at least a portion of the web 812. This allows the connection element 832 to remain close to or contact the web 812 once attached. A strip of compressive material 834, such as for example rubber, can be attached to the connection element 832. The compressive material 834 is configured to be positioned between the connection element 832 and the web 812. Referring to FIGS. 17 and 19, a fastener extends through a hole 836 in the compressive material 834 and connection element 832 and through one of the second slots 826 in the web 812 to secure the track 810 to a floor slab. The compressive material 834 compresses under pressure when the connection element 832 is attached to the slotted track 810 and acts as a gasket. The compressive material 834 additionally allows the slotted track 810 to have drift movement along the second slots 826 of slotted track 810.

Figure 20:
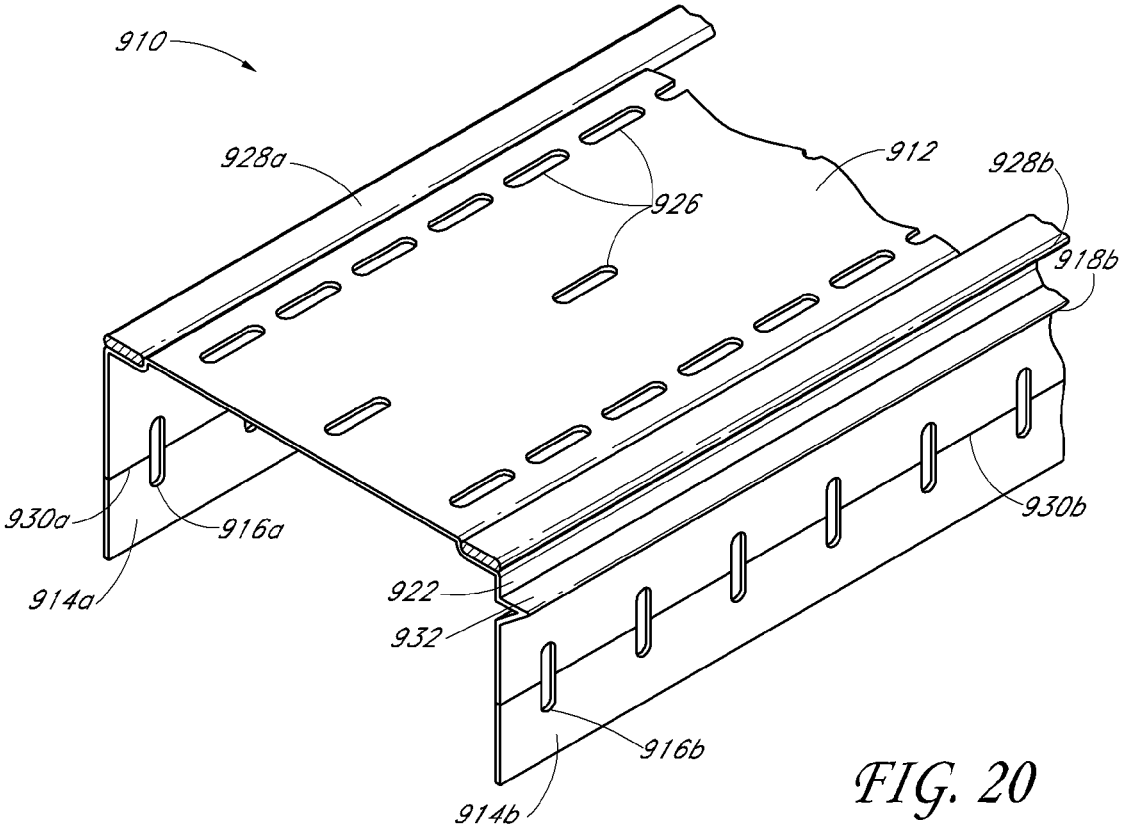
FIG. 20 illustrates a perspective view of an embodiment of a slotted track.

With reference to FIG. 20, an embodiment of a slotted track 910 can comprise a web 912, flanges 914*a* and 914*b*, a plurality of slots 916*a* and 916*b*, a protruding rib 918*b* along the flange, a sheathing attachment area 922, a pattern or patterns of second slots 926, strips of fire-retardant material 928*a* and 928*b* attached to at least a portion of the web 912, and marking guides 930*a* and 930*b* along the flanges. In yet other embodiments the track 912 can include just one flange 914, and/or more than one protruding rib 918. Other configurations and combinations of the above-listed elements are also possible. For example, a track for some applications may omit one or more of the slots 916, strips of fire-retardant material 928, marking guides 930, possibly among other of the above-recited features.

With continued reference to FIG. 20, in at least some embodiments the protruding rib 918 can have a triangular-shaped cross section, with a generally flat shelf portion 932 extending from the flange for placement of a piece of exterior sheathing. This triangular-shaped cross section and shelf can provide added structural support for the track 912, as well as any attached exterior sheathing. In at least some embodiments, shelf portion 932 can extend at a generally 90 degree angle from the flange 914*a* and/or 914*b*. In yet other embodiments the shelf portion 932 can be slightly angled in relation to the flange. For example, the shelf portion 932 and flange 914*b* can form an acute angle along the top of the protruding rib where the exterior sheathing is to rest. In such embodiments, the angle of the shelf and/or force of gravity can inhibit the exterior sheathing from slipping off of the track. The protruding rib 918*b* can have other shapes and/or cross sections as well, including but not limited to a v-shape, u-shape, or any other shape which can aid in attaching and/or retaining a piece of exterior sheathing. In at least some embodiments, the exterior sheathing can have a width, or thickness, of between about one-half inch and one inch. In some arrangements, the sheathing has a thickness of approximately ½, ⅝ or ⅞ inches. In some embodiments, the width of the shelf portion 932 can be identical to the width of the sheathing so as to provide a support area for the entire lower edge of the sheathing. In other embodiments, the width of the shelf portion can be less than or greater than the width of the sheathing. In one particular embodiment, the width of the shelf portion 932 is configured to provide a surface of a sufficient width to support the sheathing element at least for a period of time sufficient for the sheathing element to be secured to the studs and/or tracks. The shelf portion 932 may define a width that is less than the width of the sheathing element such that the shelf portion 932 does not protrude beyond the sheathing element. For example, the shelf portion 932 may be approximately one-half or less as wide, one-quarter or less as wide or one-eighth or less as wide as the sheathing element.

With continued reference to FIG. 20, the track 910 can include a guide mark or marks 930*a* and 930*b*. The guide marks can comprise a line, protrusion, rib, or any other marking which identifies locations for attachment of fasteners, including but not limited to screws, bolts, and/or rivets. For example, one guide mark can comprise a black (or other color) piece of tape added during manufacturing which identifies the central portion of each slot along the flange 914*b*. In other embodiments, the guide mark can comprise a laser mark, or ink mark, which preferably is sufficiently permanent to last through at least a normal period of time and under normal conditions of manufacturing, storage, shipping, and assembly. The guide mark 930*a* and/or 930*b* can be used to ensure that the track 910 is fastened appropriately and/or evenly to another wall component or components during building construction. Preferably, the guide mark 930*a* and/or 930*b* is located near the center of the slot, so that a stud member within the track can move equally up and down relative to the track. This can help to ensure maximum deflection capability of the stud within the wall assembly. In other embodiments, the guide mark can be offset from the center to allow for other ranges of stud movement.

Figure 21:
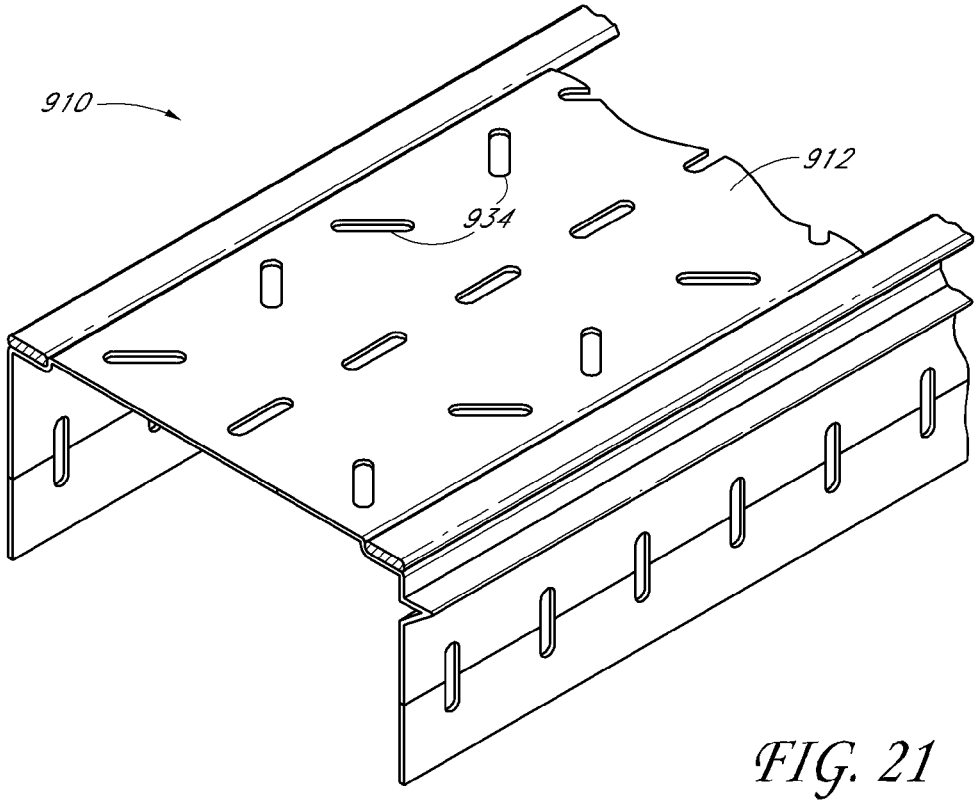
FIG. 21 illustrates a perspective view of an embodiment of a slotted track.

With reference to FIGS. 20 and 21, the web 912 can include a pattern or patterns of second slots. For example, and with reference to FIG. 20, second slots 926 can be arranged along the web portion such that at least some of the second slots 926 are closer to a central portion of the web than are other second slots 926. The pattern or patterns can vary. With continued reference to FIG. 20, the pattern can include a series of closely located second slots along both edges of the web 912, as well as scattered second slots along the center of the web 912. With reference to FIG. 21, in at least some embodiments a slot pattern can include second slots 934 which are diagonally opposed to one another. Other configurations and types of second slots are also possible.

The use of slot patterns can facilitate fastening of the track 910 to another wall component, especially when the other wall component does not line up exactly with the track 910. For example, the wall component may have openings or hollow areas adjacent some or all of the second slots which run down the center of the web 912. If all of the second slots were located along the center of the web 912, it may not be possible to attach the track 910 to the other wall component in those areas. Thus, attachment of a track 910 to another other wall component can be more easily accomplished by incorporating a pattern or patterns of second slots which are spread out along the web 912.

In addition, drift movement of the track 910 can also be possible with slot patterns such as those illustrated in FIGS. 20 and 21. For example, the second slots 926 of FIG. 20 and or the second slots 934 of FIG. 21 can be elongated such that the track 910 can drift along the second slots during a seismic event. The second slots can also be shaped in the form of a cross slot, thereby facilitating drift movement in multiple directions. Other configurations are also possible.

The present application does not seek to limit itself to only those embodiments discussed above. Other embodiments resembling tracks, wall systems, or other wall components are possible as well. Various geometries and designs may be used in the wall components to accommodate the use of fire-retardant material and/or sheathing attachment. Additionally, various materials may be used. In at least some embodiments the wall component and wall system materials can comprise steel, iron, or other material having at least some structural capacity. The fire-retardant materials can comprise intumescent material, such as for example BlazeSeal™, or some other material which accomplishes the same purposes as those described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present two-piece track assemblies have been described in the context of particularly preferred embodiments, the skilled artisan will appreciate, in view of the present disclosure, that certain advantages, features and aspects of the assemblies may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A two-piece fire-rated track assembly for a linear wall gap, comprising:

a first track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the first track defines a substantially U-shaped cross section having a maximum external width dimension;

a second track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the second track defines a substantially U-shaped cross section, each of the first and second flanges has a free end opposite a respective one of the first side edge and second side edge, wherein the first and second flanges of the second track define a minimum internal width that is greater than the maximum external width dimension of the first track;

at least one heat-expandable intumescent strip attached to the second track and extending lengthwise along a surface of the second track;

wherein, in use, the first track and the second track are aligned with one another in the same direction and the first track is nested within the second track.

2. The assembly of claim 1, wherein the at least one intumescent strip extends along and is attached to a portion of the web of the second track such that the portion contacts an adjacent structure when the two-piece track assembly is assembled to the adjacent structure.

3. The assembly of claim 1, wherein the at least one intumescent strip further comprises a portion that extends past an outer surface of the web of the second track.

4. The assembly of claim 2, wherein the at least one intumescent strip defines a total length in a cross-sectional direction, wherein a portion of the total length located on the flange is at least three times greater than a portion of the total length on the web.

5. The assembly of claim 2, wherein the at least one intumescent strip covers a substantial entirety of the outer surface of the flange.

6. The assembly of claim 2, wherein the at least one intumescent strip comprises a first intumescent strip and a second intumescent strip on the first and second flanges, respectively.

7. The assembly of claim 1, wherein the first and second flanges of the first track are longer than the first and second flanges of the second track.

8. The assembly of claim 7, wherein the first and second flanges of the first track are at least twice as long as the first and second flanges of the second track.

9. The assembly of claim 1, further comprising a plurality of slots on the first and second flanges of the first track, wherein the slots extend in a direction perpendicular to a length of the first track.

10. The assembly of claim 1, wherein the first track is a footer or header track.

11. The assembly of claim 1, wherein the first track is a metal stud.

* * * * *